US012808154B2

(12) United States Patent
Hirose

(10) Patent No.: US 12,808,154 B2
(45) Date of Patent: Nov. 24, 2026

(54) REMOTE OPERATION SYSTEM FOR A WORK MACHINE

(71) Applicant: KOBELCO CONSTRUCTION MACHINERY CO., LTD., Hiroshima (JP)

(72) Inventor: Ryuichi Hirose, Tokyo (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 60 days.

(21) Appl. No.: 18/864,987

(22) PCT Filed: Apr. 3, 2023

(86) PCT No.: PCT/JP2023/013797
§ 371 (c)(1),
(2) Date: Nov. 12, 2024

(87) PCT Pub. No.: WO2023/233800
PCT Pub. Date: Dec. 7, 2023

(65) Prior Publication Data

US 2026/0035882 A1 Feb. 5, 2026

(30) Foreign Application Priority Data

Jun. 2, 2022 (JP) ..... 2022-090457

(51) Int. Cl.
*E02F 9/20* (2006.01)

(52) U.S. Cl.
CPC ..... *E02F 9/205* (2013.01)

(58) Field of Classification Search
CPC ..... E02F 9/205; G08C 2201/42; G08C 17/00
See application file for complete search history.

(56) References Cited

U.S. PATENT DOCUMENTS

2012/0136507 A1 5/2012 Everett et al.
2021/0009392 A1 1/2021 Kamiya et al.

FOREIGN PATENT DOCUMENTS

CN 112823226 A * 5/2021 ..... E02F 9/205
JP H10-219748 A 8/1998
JP 2007-295033 A 11/2007
(Continued)

OTHER PUBLICATIONS

Translation to English of reference CN112823226A. (Year: 2019).*
(Continued)

*Primary Examiner* — Michael C Zarroli
(74) *Attorney, Agent, or Firm* — Carrier, Shende & Associates P.C.; Joseph P. Carrier; Jeffrey T. Gedeon

(57) ABSTRACT

Provided is a remote operation system for a work machine. When a work machine stop operation is executed by an operator during execution of the remote operation and a specified operation for executing resumption or end of the remote operation is executed by the operator with an on-hand terminal, a remote control apparatus of a remote operation system executes resumption processing or end processing of the remote operation, and the remote control apparatus and a work machine control apparatus maintain a communication connected state during a period between the execution of the work machine stop operation and the specified operation is to be executed.

10 Claims, 21 Drawing Sheets

(56) References Cited

FOREIGN PATENT DOCUMENTS

| | | | |
|---|---|---|---|
| JP | 2019-167213 | A | 10/2019 |
| JP | 2020-082553 | A | 6/2020 |

OTHER PUBLICATIONS

PCT/ISA/210 from International Application PCT/JP2023/013797 with the English translation thereof.
PCT/ISA/237 from International Application PCT/JP2023/013797.
Extended European Search Report dated Jul. 9, 2025 issued in the corresponding EP Patent Application No. 23815562.6.

* cited by examiner

REMOTE OPERATION SYSTEM FOR A WORK MACHINE

TECHNICAL FIELD

The present invention relates to a remote operation system for an operator to perform a remote operation of a working machine.

BACKGROUND ART

Up to now, known remote operation systems of a working machine include one described in Patent Literature 1. This remote operation system comprises a construction machine serving as a working machine which comprises a reception apparatus, and a transmission apparatus. In this remote operation system, in response to the transmission apparatus operated by the operator, start and stop of the working machine are remotely operated.

CITATION LIST

Patent Literature

Patent Literature 1: Japanese Patent Laid-Open No. 10-219748

SUMMARY OF INVENTION

Technical Problem

In recent years, in a remote operation system, it has been a common practice to execute a communication connection operation when a remote operation of a working machine is to be started. In such a remote operation system, when the remote operation system of Patent Literature 1 has been adopted, the communication connection operation needs to be performed each time the working machine is restarted after a pause. As a result, a problem arises that it takes time to resume the remote operation after the pause.

An object of the present invention, which has been made to address the above-mentioned problem, is to provide a remote operation system which can reduce time from when the remote operation is paused to when the remote operation is resumed.

Solution to Problem

To achieve the object, the present invention is a remote operation system for an operator to perform a remote operation of a working machine via a remote operation apparatus with a remote input unit, the remote operation system comprising a remote control element configured to execute resumption processing or end processing of the remote operation when a specified operation for executing resumption or end of the remote operation has been executed in the remote input unit by the operator in a case where a real machine stop operation of the working machine has been executed via the remote operation apparatus by the operator during execution of the remote operation, and a communication control element configured to establish a communication connected state between the remote operation apparatus and the working machine such that, when the remote operation is to be started, the remote operation of the working machine is enabled and to maintain the communication connected state during a period since the execution of the real machine stop operation until the specified operation is to be executed.

DESCRIPTION OF EMBODIMENTS

Figure 1:
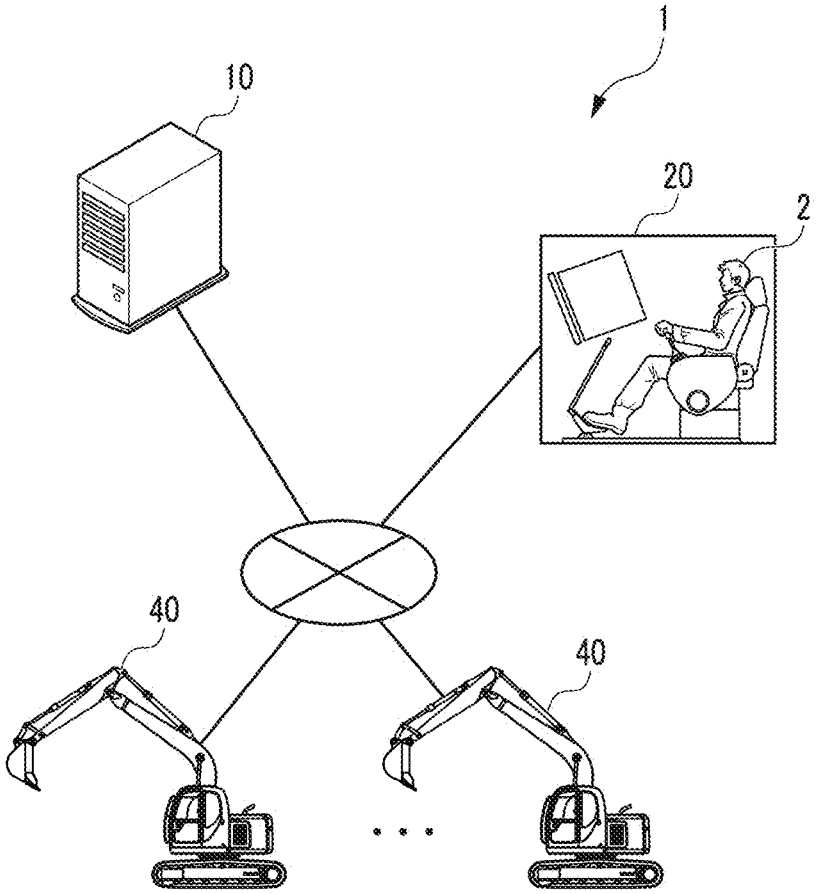
FIG. 1 illustrates a configuration of a remote operation system according to an embodiment of the present invention.

Hereinafter, with reference to the drawings, a remote operation system according to an embodiment of the present invention will be described. As illustrated in FIG. 1, a remote operation system 1 of the present embodiment is constituted of a remote operation support server 10, a plurality of remote operation apparatuses 20 (only one of which is illustrated in the drawing), a plurality of working machines 40 (only two of which are illustrated in the drawing), and the like.

In this remote operation system 1, when any one of the plurality of remote operation apparatuses 20 is operated by an operator 2, any one of the plurality of working machines 40 is remotely operated.

In the remote operation system 1, the remote operation support server 10, the plurality of remote operation apparatuses 20, and the plurality of working machines 40 are configured so as to be mutually communicable via a network. A communication network for the remote operation support server 10 and the remote operation apparatus 20 and a communication network for the remote operation support server 10 and the working machine 40 may be the same or may be different from each other.

Figure 2:
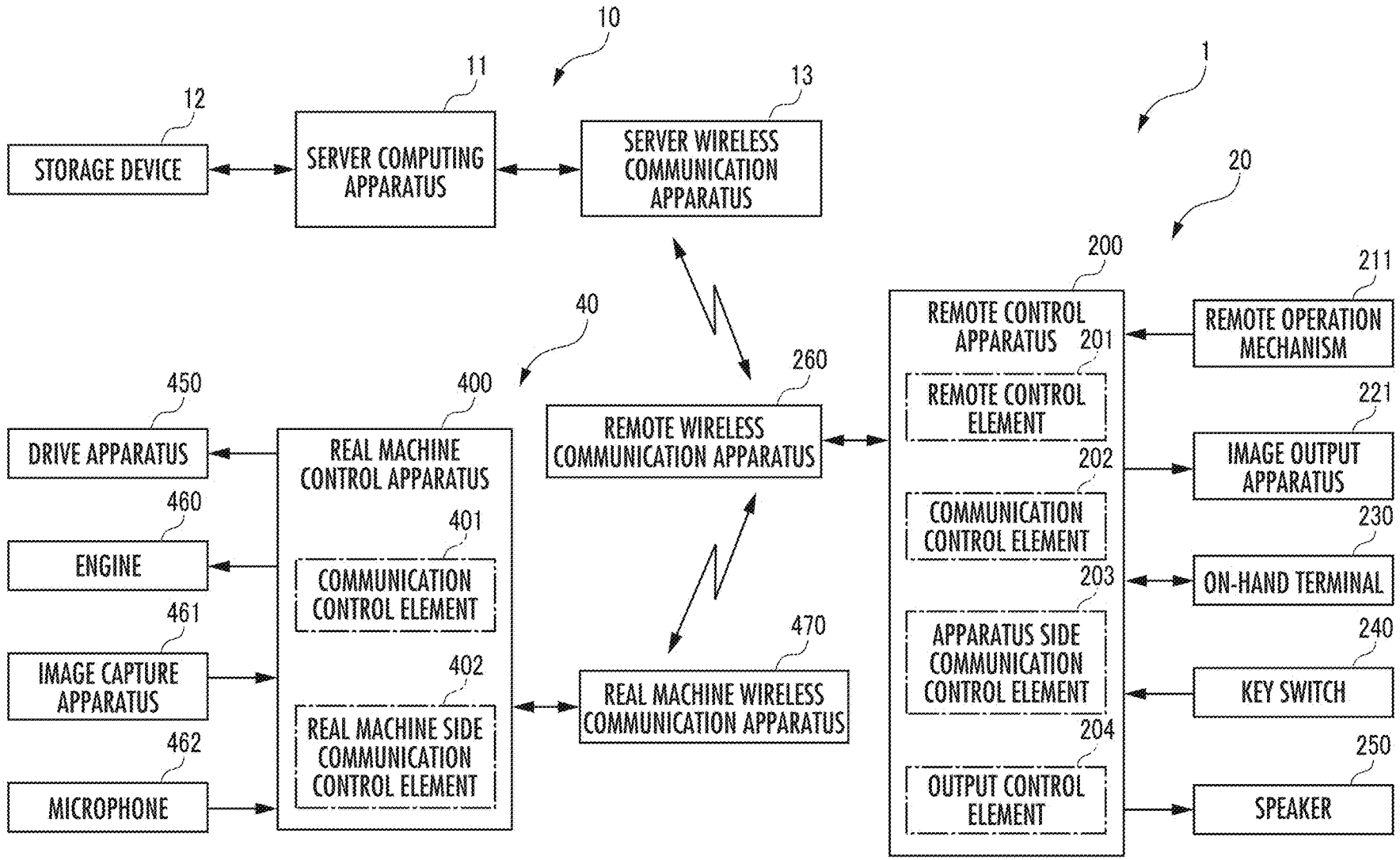
FIG. 2 is a block diagram illustrating an electric configuration of the remote operation system.

As illustrated in FIG. 2, the remote operation support server 10 comprises a server computing apparatus 11, a storage device 12, a server wireless communication apparatus 13, and the like. The server computing apparatus 11 is constituted of a CPU or the like and reads necessary data and software from the storage device 12 to execute various computation processing, various control processing, and the like.

The storage device 12 is constituted of a storage, a memory, and the like and stores and bolds an operation schedule of the working machine 40, data of a work log of the operator 2, and the like.

In this remote operation support server 10, communication is executed between a remote wireless communication apparatus 260 which will be described below of the remote operation apparatus 20 and a real machine wireless communication apparatus 470 of the working machine 40 via the communication network by the server wireless communication apparatus 13. According to the present embodiment, the remote wireless communication apparatus 260 is equivalent to an apparatus side communication apparatus, and the real machine wireless communication apparatus 470 is equivalent to a real machine side communication apparatus.

Figure 3:
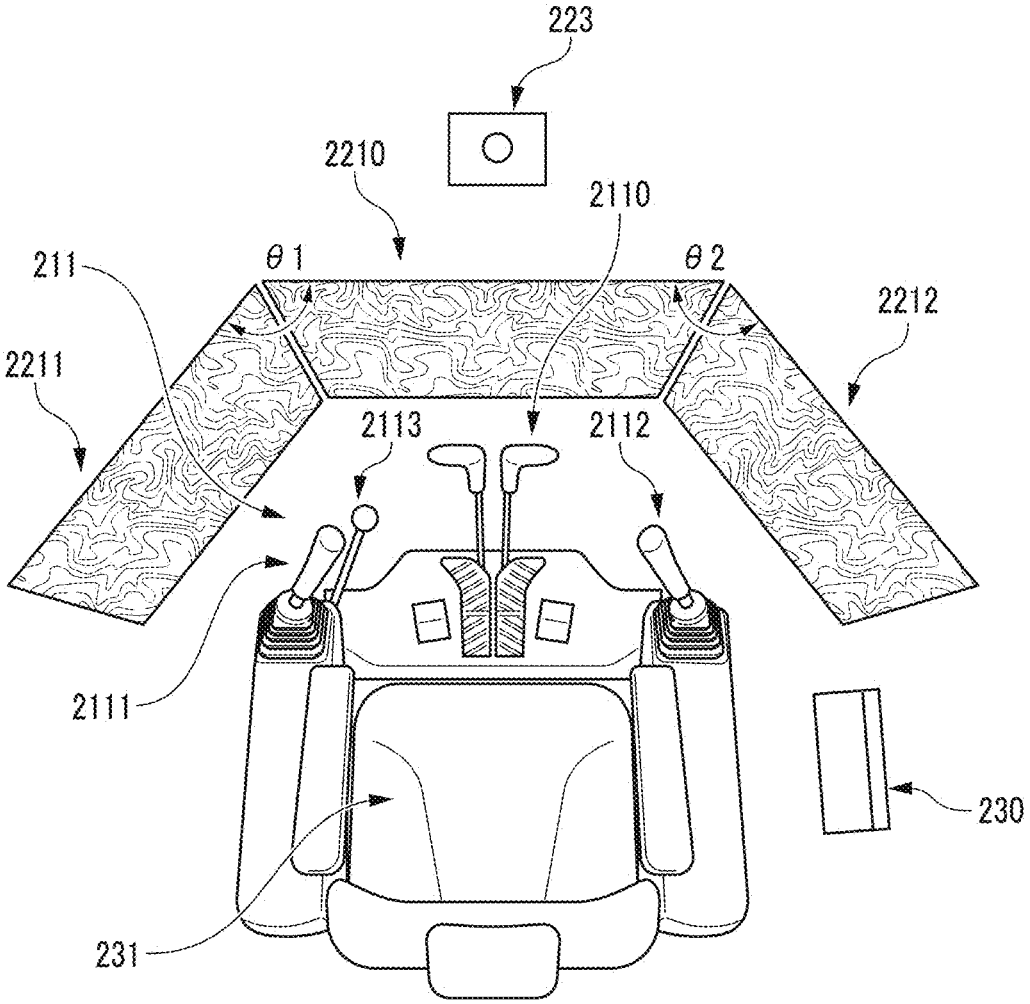
FIG. 3 illustrates a configuration of a remote operation apparatus in a two-dimensional manner.

As illustrated in FIG. 2 and FIG. 3, the remote operation apparatus 20 comprises a remote control apparatus 200, a remote operation mechanism 211, an image output apparatus 221, an operator recognition apparatus 223, an on-hand terminal 230, a key switch 240, a speaker 250, the remote wireless communication apparatus 260, and the like. The remote control apparatus 200 is obtained by combining a plurality of controllers, and each of the controllers is constituted of a CPU, a storage device (a storage, a RAM, a ROM), an input and output interface, and the like (none of which is illustrated in the drawing). The remote control apparatus 200 reads necessary data and software programs from the storage device and executes various control processing as will be described below.

As illustrated in FIG. 2, the remote control apparatus 200 comprises functions as a remote control element 201, a communication control element 202, an apparatus side communication control element 203, and an output control element 204, and these functions are realized by executing the software programs by the remote control apparatus 200.

The remote operation mechanism 211 includes an operation apparatus for travel, an operation apparatus for revolution, an operation apparatus for boom, an operation apparatus for arm, an operation apparatus for bucket, and the like. Each of the operation apparatuses includes an operation lever which receives a rotational operation. The operation lever (travel lever) of the operation apparatus for travel is operated to move an undercarriage 410 of the working machine 40.

The operation lever (revolution lever) of the operation apparatus for revolution is operated to move a revolution mechanism 430 of the working machine 40. The operation lever (boom lever) of the operation apparatus for boom is operated to move a boom cylinder 442 of the working machine 40. The operation lever (arm lever) of the operation apparatus for arm is operated to move an arm cylinder 444 of the working machine 40. The operation lever (backet lever) of the operation apparatus for bucket is operated to move a bucket cylinder 446 of the working machine 40.

As illustrated in FIG. 3, for example, each of operation levers constituting the remote operation mechanism 211 is arranged in a surrounding of a seat 231 for the operator to sit on. A pair of left and right travel levers 2110 corresponding to left and right crawlers are arranged side by side on the left and right in front of the seat 231. One operation lever may serve as a plurality of operation levers.

For example, a left operation lever 2111 provided in front of a left frame of the seat 231 illustrated in FIG. 3 may function as the arm lever when being operated in a front and back direction and may function as the revolution lever when being operated in a left and right direction. Similarly, a right operation lever 2112 provided in front of a right frame of the seat 231 illustrated in FIG. 3 may function as the boom lever when being operated in the front and back direction and may function as the backet lever when being operated in the left and right direction. A lever pattern may be optionally changed depending on an operation instruction of the operator.

A shutoff lever 2113 is provided below the left operation lever 2111 in front of the left frame of the seat 231. This shutoff lever 2113 functions as an operation lever which locks the working machine 40 so as not to be moved when being raised even when each of the operation levers 2110, 2111, and 2112 is operated, and which releases the lock when being lowered.

Specifically, the shutoff lever 2113 is configured to be operable by the operator between a lock position on an upper position and a release position below the lock position. In a case where the shutoff lever 2113 has been raised from the release position to the lock position, the working machine 40 is locked so as not to be moved even when each of the operation levers 2110, 2111, and 2112 is operated. On the other hand, in a case where the shutoff lever 2113 has been lowered from the lock position to the release position, the lock is released.

A large number of sensors which are not illustrated in the drawing are provided in the remote operation mechanism 211, and when each of the operation levers of the remote operation mechanism 211 has been operated, these sensors output detection signals representing the operation states to the remote control apparatus 200. The remote control apparatus 200 obtains the operation state of the remote operation mechanism 211 by the operator 2 based on the detection signals of these sensors.

The image output apparatus 221 is constituted of a central image output apparatus 2210, the left image output apparatus 2211, and the right image output apparatus 2212 having substantially rectangular screens which are respectively arranged in front of, in front and to the left of, and in front and to the right of the seat 231 as illustrated in FIG. 3. A shape and a size of the screens (image display areas) of each of the central image output apparatus 2210, the left image output apparatus 2211, and the right image output apparatus 2212 may be the same or may be different from one another.

As illustrated in FIG. 3, a right edge of the left image output apparatus 2211 is adjacent to a left edge of the central image output apparatus 2210 in a manner that the screen of the central image output apparatus 2210 and the screen of the left image output apparatus 2211 form an inclination angle $\theta 1$ (for example, $120° \leq 01 \leq$) $150°$. As illustrated in FIG. 3, a left edge of the right image output apparatus 2212 is adjacent to a right edge of the central image output apparatus 2210 in a manner that the screen of the central image output apparatus 2210 and the screen of the right image output apparatus 2212 form an inclination angle $\theta 2$ (for example, $120° \leq \theta 2 \leq$) $150°$. The inclination angles $\theta 1$ and $\theta 2$ may be the same or may be different from each other.

The screen of each of the central image output apparatus 2210, the left image output apparatus 2211, and the right image output apparatus 2212 may be parallel to a vertical direction or may be inclined to the vertical direction. At least one image output apparatus among the central image output apparatus 2210, the left image output apparatus 2211, and the right image output apparatus 2212 may be constituted of image output apparatuses divided into a plurality of components. For example, the central image output apparatus 2210 may be constituted of a pair of image output apparatuses having substantially rectangular screens which are vertically adjacent to each other. When an image capture data signal from the working machine 40 has been received by the remote wireless communication apparatus 260, the remote control apparatus 200 causes image capture data included in the image capture data signal to be displayed on the image output apparatus 221.

The on-hand terminal 230 (remote input unit) is of a touch panel system. As will be described below, the on-hand terminal 230 displays various screens based on signals from the remote control apparatus 200, and when being touch operated by the operator 2, outputs a signal representing the touch operation to the remote control apparatus 200.

The operator recognition apparatus 223 is an apparatus configured to obtain an image, a sound, an individual identification number, or the like of the operator 2 to identify an individual operator. The operator recognition apparatus 223 is provided in a forward part of the remote operation mechanism 211 while facing backwards towards the seat 231. The operator recognition apparatus 223 captures the operator 2 sitting on the seat 231 after activation of the remote control apparatus 200. As will be described below, an image captured by the operator recognition apparatus 223 is obtained as authentication data and transmitted to the remote operation support server 10 via a network. Thus, the remote operation support server 10 identifies the individual operator by way of face authentication through matching against authentication data serving as information of the registered operator 2 which is saved in the storage device 12 of the remote operation support server 10.

The operator recognition apparatus 223 may be an operator information input apparatus provided in the remote control apparatus 200 and configured to input the individual identification number or the like of the operator 2 instead of an image capture apparatus, or may be both the image capture apparatus and the operator information input apparatus. The operator information input apparatus may be an apparatus which can input information via the on-hand terminal 230, or may be a sound recognition apparatus which has a microphone and recognizes a voice of the operator 2 itself or a password set for each operator.

The key switch 240 is configured to start an engine 460 of the working machine 40 or stop an operation of the engine 460 and arranged in a vicinity of the remote operation mechanism 211. The key switch 240 is configured such that a position of the key switch can be changed to at least three positions including a key off position, a key on position, and a key start position. When the key switch has been operated by the operator 2, the key switch outputs signals (a key off position signal, a key on position signal, and a key start position signal) representing the positions of the key switch 240 to the remote control apparatus 200.

The remote control apparatus 200 transmits signals for instructing start and operation stop of the engine 460 to the real machine wireless communication apparatus 470 of the working machine 40 via the remote wireless communication apparatus 260 based on operation signals from the key switch 240.

The speaker 250 is provided in a vicinity of the seat 231. When an acoustic data signal from the working machine 40 which will be described below has been received by the remote wireless communication apparatus 260, the remote control apparatus 200 outputs acoustic data included in the acoustic data signal from the speaker 250.

As illustrated in FIG. 2, the working machine 40 comprises a real machine control apparatus 400, a drive mechanism 450, the engine 460, an image capture apparatus 461, a microphone 462, the real machine wireless communication apparatus 470, and the like.

The real machine control apparatus 400 is obtained by combining a plurality of controllers, and each of the controllers is constituted of a CPU, a storage device (a storage, a RAM, a ROM), an input and output interface, and the like (none of which is illustrated in the drawing). The real machine control apparatus 400 reads necessary data and software programs from the storage device and executes various control processing as will be described below.

As illustrated in FIG. 2, the real machine control apparatus 400 comprises functions as a communication control element 401 and a real machine side communication control element 402, and these functions are realized by execution of the software programs by the real machine control apparatus 400.

Figure 4:
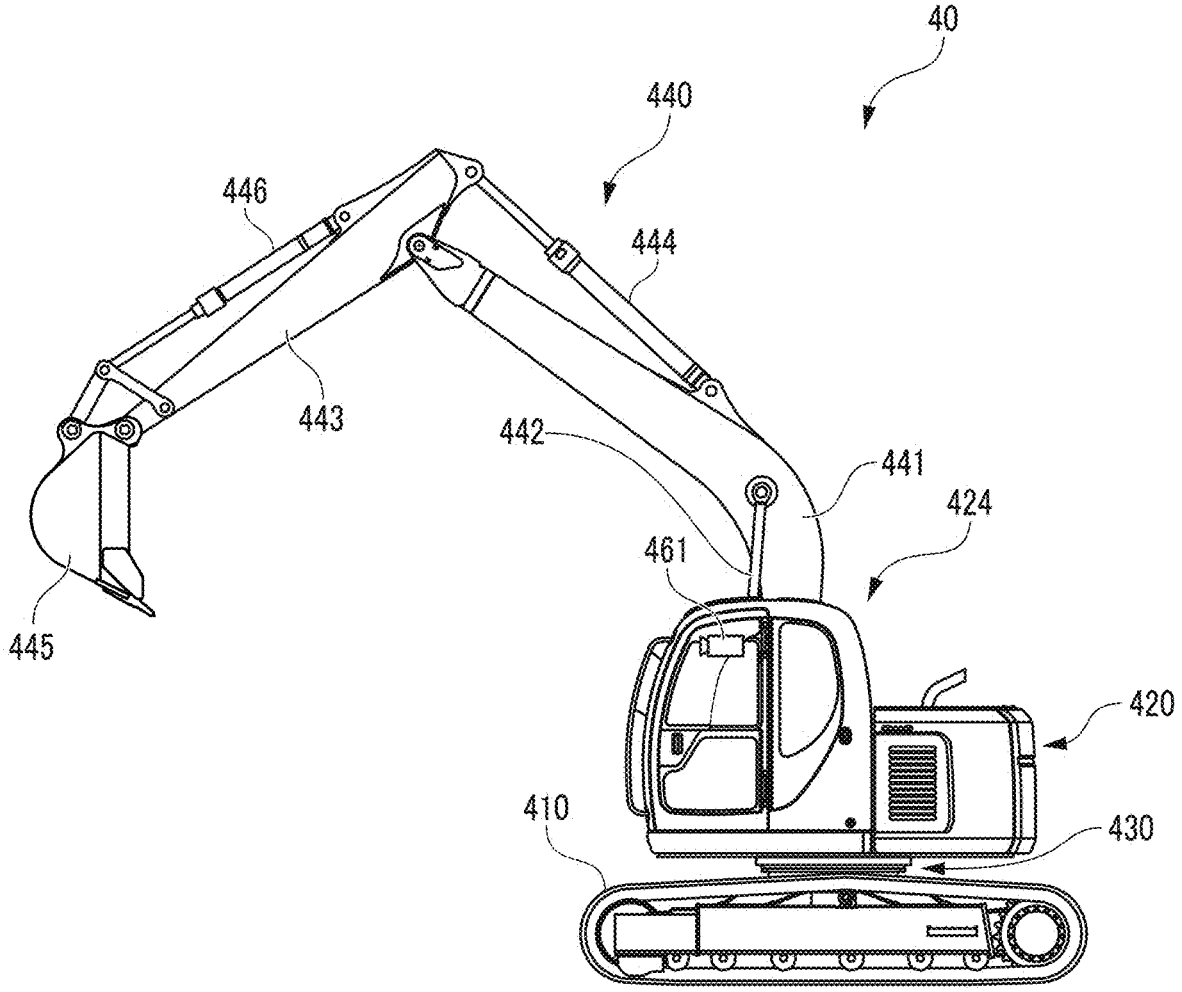
FIG. 4 illustrates a configuration of a working machine.

The working machine 40 is a construction machine of a crawler shovel type, and as illustrated in FIG. 4, comprises the undercarriage 410 of a crawler system, a revolving superstructure 420 mounted to the undercarriage 410 via the revolution mechanism 430 so as to be able to revolve, and the like.

A cab 424 (cockpit house) is provided in a front left part of the revolving superstructure 420. A work attachment 440 is provided in a front central part of the revolving superstructure 420.

The work attachment 440 comprises a boom 441 mounted to the revolving superstructure 420 so as to be able to erect and lay down, an arm 443 pivotally connected to a distal end of the boom 441, and a bucket 445 pivotally connected to a distal end of the arm 443. The boom cylinder 442, the arm cylinder 444, and the bucket cylinder 446 which are constituted of extendable hydraulic cylinders are mounted to the work attachment 440.

The boom cylinder 442 intervenes between the boom 441 and the revolving superstructure 420 so as to expand and contract by being supplied with hydraulic oil to cause the boom 441 to rotate in an erecting and laying direction. The arm cylinder 444 intervenes between the arm 443 and the boom 441 so as to expand and contract by being supplied with hydraulic oil to cause the arm 443 to rotate around a horizontal axis relative to the boom 441. The bucket cylinder 446 intervenes between the bucket 445 and the arm 443 so as to expand and contract by being supplied with hydraulic oil to cause the bucket 445 to rotate around the horizontal axis relative to the arm 443.

A real machine operation mechanism (not illustrated) and the drive mechanism 450 are provided in the cab 424. This real machine operation mechanism comprises a plurality of real machine operation levers similarly arranged as in the remote operation mechanism 211 in a surrounding of the seat arranged inside the cab 424. The plurality of these real machine operation levers are driven by the drive mechanism 450.

When a signal representing the operation state of the remote operation mechanism 211 has been received by the real machine wireless communication apparatus 470, the real machine control apparatus 400 controls an operation state of the drive mechanism 450 so as to drive the plurality of real machine operation levers of the real machine operation mechanism based on the signal.

The engine 460 is of an internal combustion engine type and comprises a fuel injection valve and the like. The real machine control apparatus 400 controls an operation state of the engine 460 by controlling an operation state of the fuel injection valve as will be described below. The engine 460 is not limited to an engine of the internal combustion engine type, and an electric motor may be used. An engine obtained by combining the electric motor and the internal combustion engine may be used.

In general, in the case of a construction machine of an ordinary crawler shovel type which is not intended for the remote operation, the operator on the seat in the cab changes the position of the key switch mounted besides the seat to each of the key off position, the key on position, and the key start position so that an electronic device and the engine of the construction machine are operated.

Specifically, a power source is not supplied to the electronic device when the key switch is at the key off position. By changing the key switch at the key off position to the key on position, the power source is supplied to the electronic device of the construction machine to activate the electronic device. The power source is also supplied to an electric circuit configured to start the engine to be put into a standby state for starting the engine. The key switch is further changed to the key start position, so that the engine is started. The key switch changed to the key start position is maintained to the key on position after the start of the engine.

In contrast, the working machine 40 of the present embodiment is a construction machine intended for the remote operation. For this reason, as being different from the construction machine of the ordinary crawler shovel type, when the position of the key switch 240 of the remote control apparatus 200 is changed by the operator 2, the electronic device and the engine 460 of the working machine 40 are operated.

Specifically, the power source is not supplied to the electronic device when the key switch 240 is at the key off position. The electronic device herein is an electronic device except for the real machine control apparatus 400, the drive mechanism 450, the image capture apparatus 461, and the microphone 462 which are necessary to perform the remote operation, and is an electronic device which is mounted to the construction machine of the ordinary crawler shovel type too.

When the key switch 240 is changed from the key off position to the key on position, the power source is supplied to the electronic device of the working machine 40 to activate the electronic device. The power source is also supplied to the electric circuit configured to start the engine 460 to put them into the standby state for starting the engine 460. The key switch 240 is further changed to the key start position, so that the engine 460 is started.

The image capture apparatus 461 is of a camera type installed inside the cab 424 and captures an environment including a front area of the cab 424 through a front window and a pair of left and right side windows to output an image capture data signal including image capture data of the environment to the real machine control apparatus 400. The real machine control apparatus 400 transmits this image capture data signal to the remote wireless communication apparatus 260 via the real machine wireless communication apparatus 470.

The microphone 462 outputs an acoustic data signal including a sound in a surrounding of the working machine 40 as acoustic data to the real machine control apparatus 400. The real machine control apparatus 400 transmits this acoustic data signal to the remote wireless communication apparatus 260 via the real machine wireless communication apparatus 470.

Next, with reference to FIG. 5, various control processing at the time of start of the remote operation will be described. At least one of the server computing apparatus 11 in the remote operation support server 10, the remote control apparatus 200 in the remote operation apparatus 20, and the real machine control apparatus 400 in the working machine 40 executes various control processing illustrated in FIG. 5. Regarding this aspect, the same also applies to various control processing which will be described below.

Figure 5:
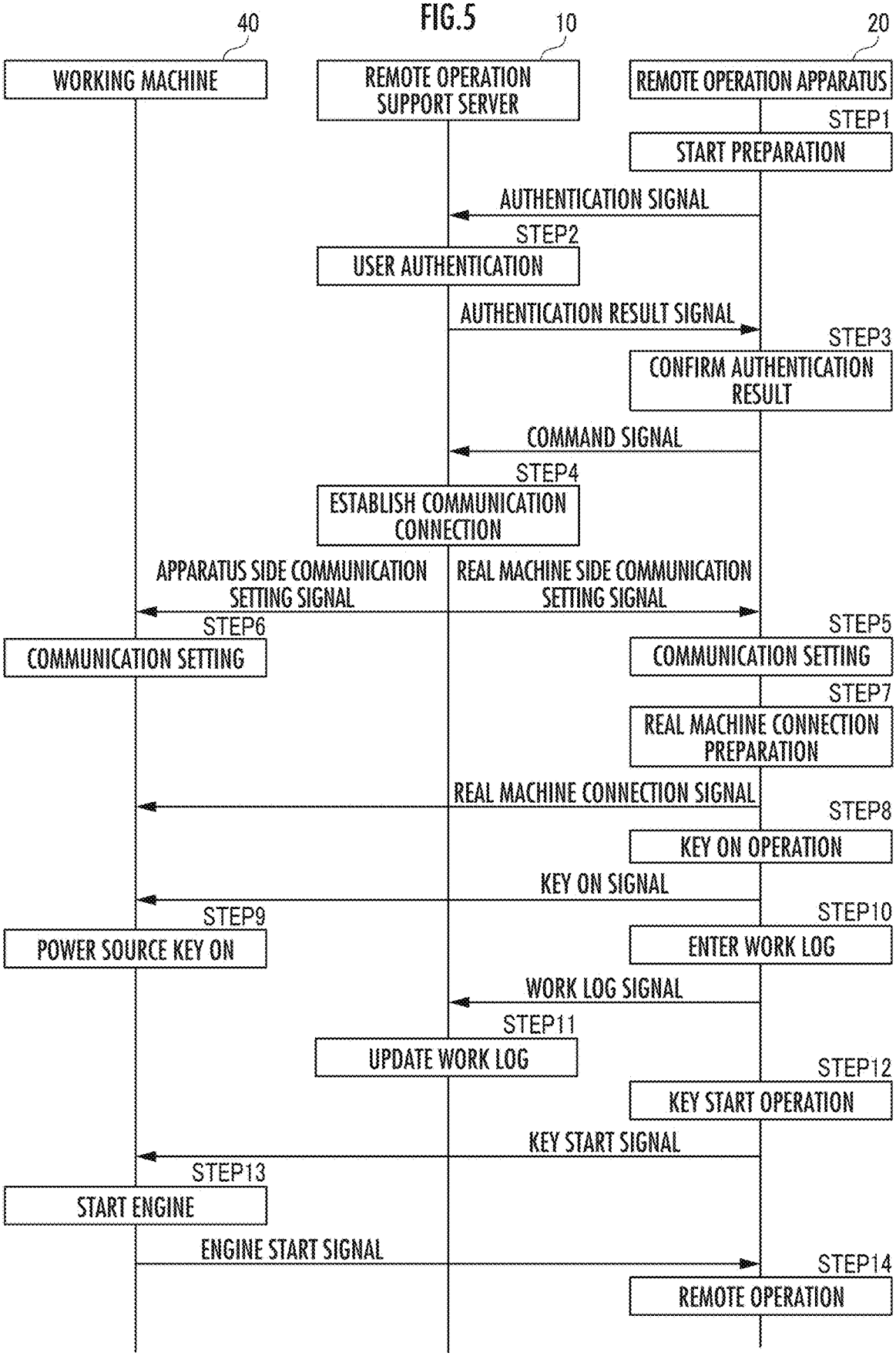
FIG. 5 is a sequence diagram illustrating control processing at the time of start of a remote operation.

As illustrated in the same drawing, first, start preparation processing is executed in the remote operation apparatus 20 (FIG. 5/STEP 1).

Figure 6:
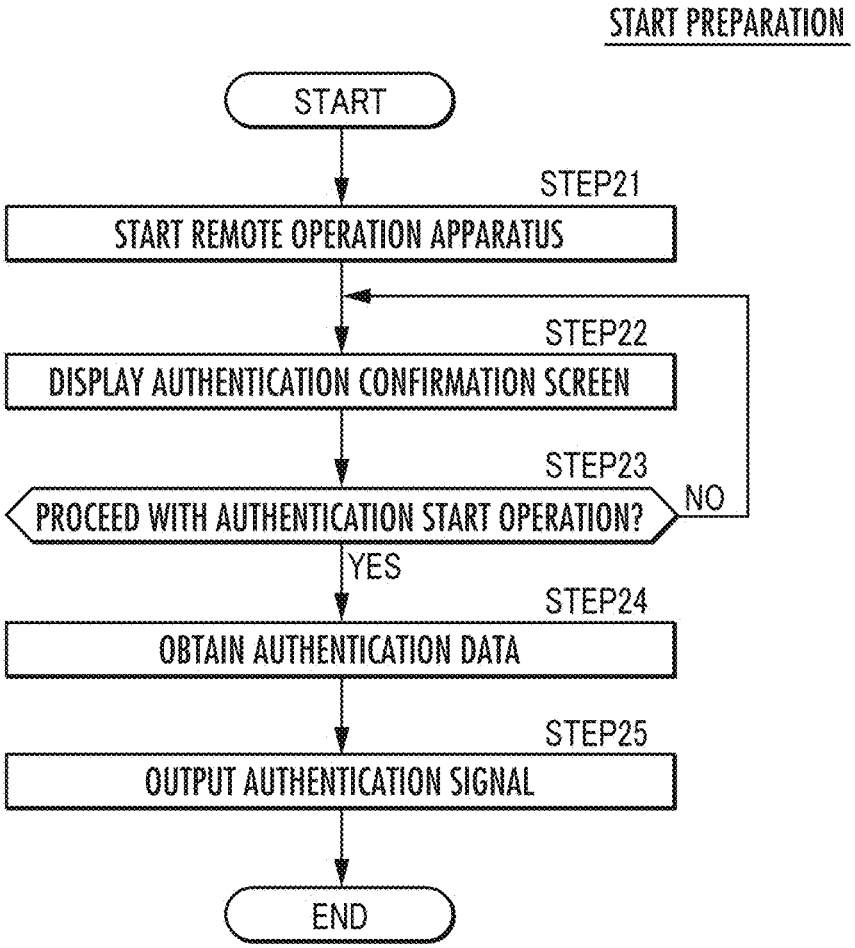
FIG. 6 is a flowchart illustrating start preparation processing.

This start preparation processing is specifically executed as illustrated in FIG. 6. First, the remote operation apparatus 20 is started (FIG. 6/STEP 21). Specifically, when a power source button (not illustrated) of the remote operation apparatus 20 is turned on by the operator 2, the remote operation apparatus 20 is started.

Figure 9:
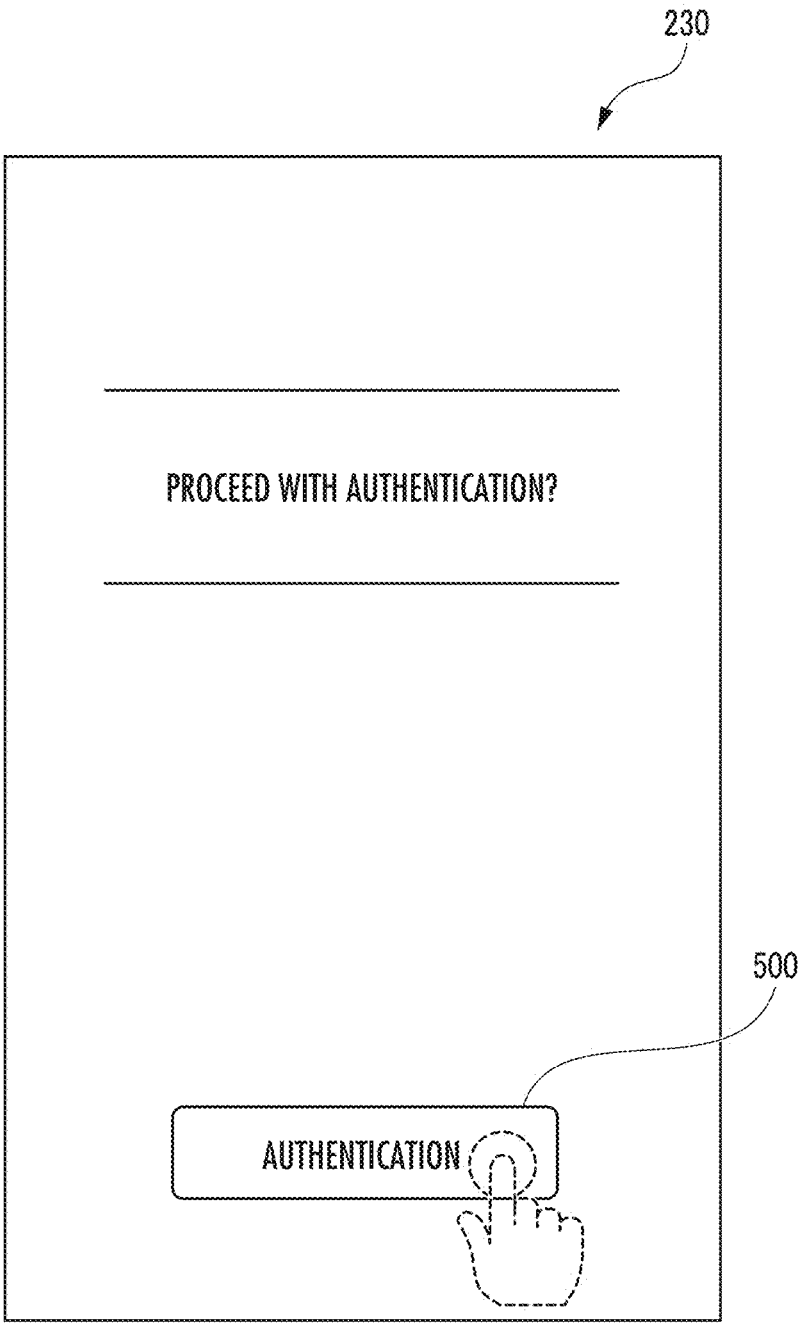
FIG. 9 illustrates an authentication confirmation screen.

Subsequently, an authentication confirmation screen illustrated in FIG. 9 is displayed on the on-hand terminal 230 (FIG. 6/STEP 22). A message "proceed with authentication?" is displayed in an upper part of this authentication confirmation screen, and an authentication button 500 is displayed in a lower part of the screen.

Next, it is determined whether or not an authentication start operation has been performed (FIG. 6/STEP 23). In this case, it is determined that the authentication start operation has been performed when the authentication button 500 has been pressed by the operator 2, and it is determined that the authentication start operation has not been performed in other occasions.

When this determination is negative (FIG. 6/STEP 23 . . . NO), the flow returns to STEP 22. On the other hand, when this determination is affirmative (FIG. 6/STEP 23 . . . YES) and the authentication start operation has been performed, processing of obtaining authentication data is executed (FIG. 6/STEP 24). In this processing of obtaining authentication data, authentication data for identifying an individual operator is obtained by the operator recognition apparatus 223 described above.

Subsequently, an authentication signal including the above-mentioned authentication data is output to the remote operation support server 10 (FIG. 6/STEP 25). Thereafter, the present processing ends.

With reference to FIG. 5 again, as described above, after the start preparation processing has been executed in the remote operation apparatus 20, in a case where the authentication signal has been received by the remote operation support server 10, user authentication processing is executed in the remote operation support server 10 (FIG. 5/STEP 2).

In this user authentication processing, after the user authentication has been executed based on the authentication data included in the authentication signal and the authentication data registered in the remote operation support server 10, an authentication result signal is output to the remote operation apparatus 20.

In this case, the authentication result signal is configured to include, when the user authentication has been successful, authentication result data representing the success and work content data based on a work plan of the operator 2 who has succeeded in the user authentication, and is configured to include, when the user authentication has failed, only authentication result data representing the failure.

As described above, after the user authentication processing has been executed in the remote operation support server 10, in a case where the authentication result signal has been received by the remote operation apparatus 20, authentication result confirmation processing is executed in the remote operation apparatus 20 (FIG. 5/STEP 3).

Figure 7:
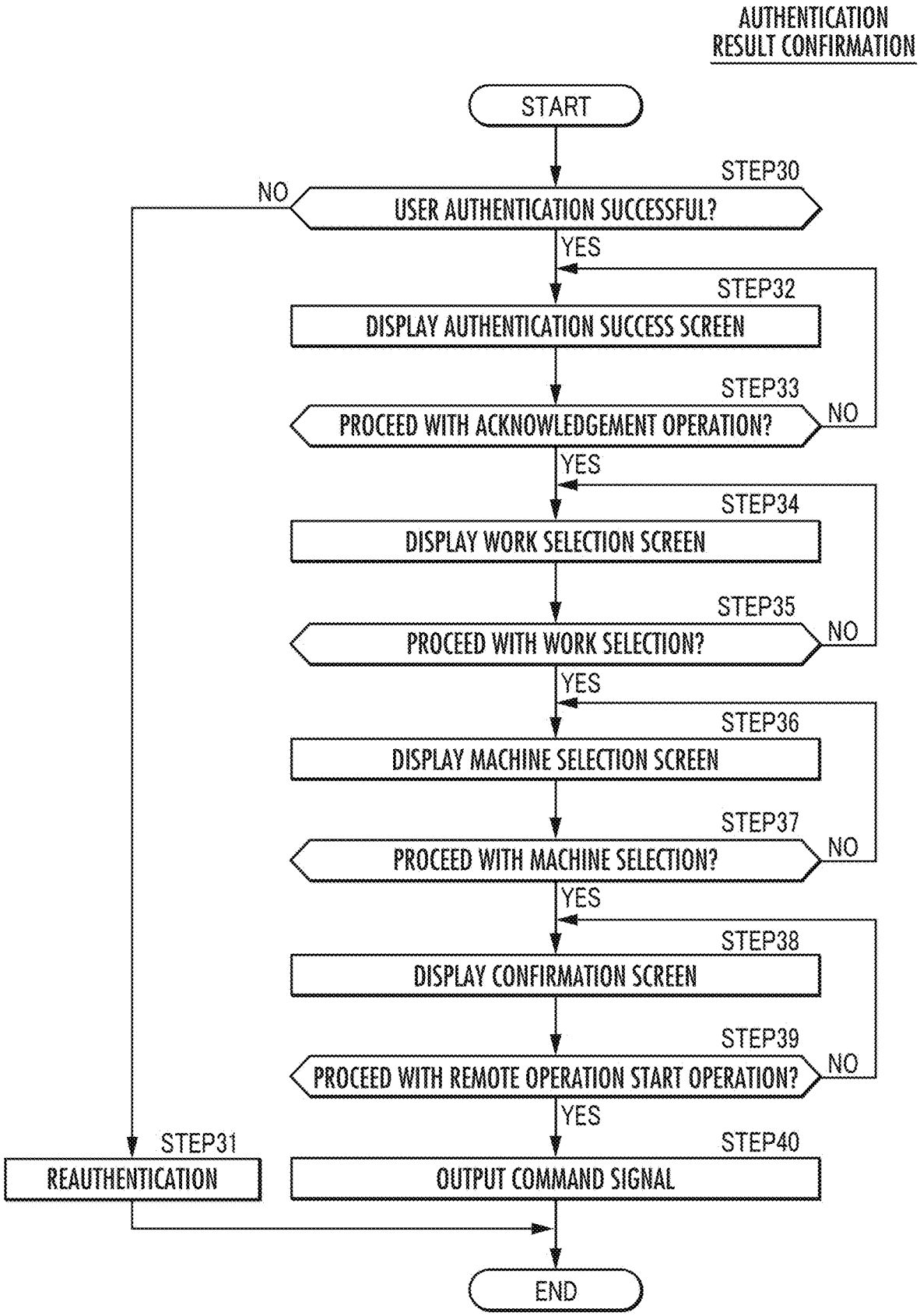
FIG. 7 is a flowchart illustrating authentication result confirmation processing.

Specifically, this authentication result confirmation processing is executed as illustrated in FIG. 7. As illustrated in the same drawing, first, it is determined whether or not the user authentication of the operator 2 has been successful based on the authentication result data in the authentication result signal (FIG. 7/STEP 30).

When this determination is negative (FIG. 7/STEP 30 . . . NO) and the user authentication of the operator 2 has failed, reauthentication processing is executed. In this reauthentication processing, a picture representing that the user authentication has failed and a reauthentication button for performing a reauthentication (none of which is illustrated in the drawing) are displayed on the on-hand terminal 230. When the reauthentication button has then been pressed by the operator 2, processing in STEPS 22 to 25 of FIG. 6 described above is executed. As described above, after the reauthentication processing has been executed, the present processing ends.

Figure 10:
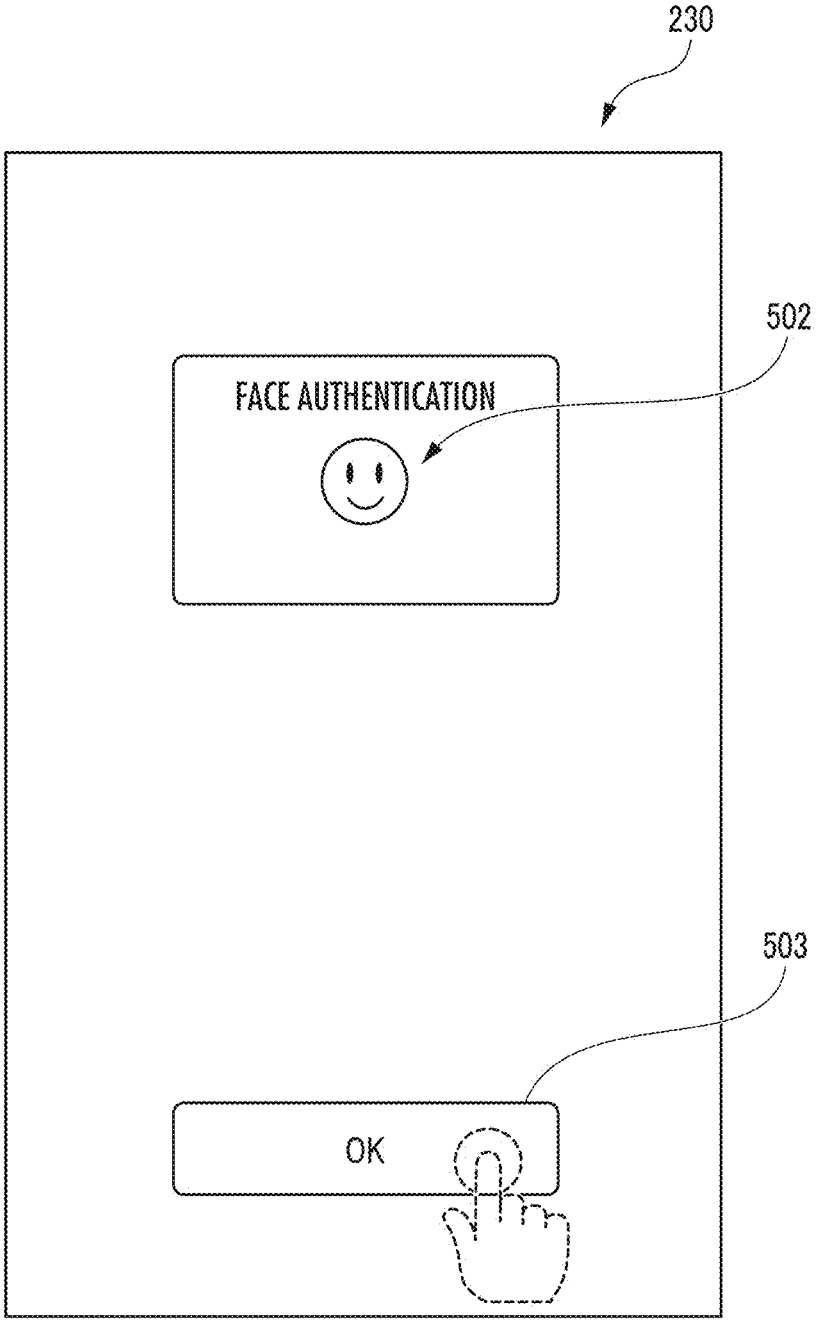
FIG. 10 illustrates an authentication success screen.

On the other hand, when the above-described determination is affirmative (FIG. 7/STEP 30 . . . YES) and the user authentication of the operator 2 has been successful, an authentication success screen illustrated in FIG. 10 is displayed on the on-hand terminal 230 (FIG. 7/STEP 32). In the case of this authentication success screen, a text "face authentication" and a face mark symbol 502 indicating that the face authentication has been successful are displayed on an upper part of the screen, and an OK button 503 is displayed on a lower part of the screen.

Subsequently, it is determined whether or not an acknowledgement operation has been performed (FIG. 7/STEP 33). In this case, when the OK button 503 has been pressed, it is determined that the acknowledgement operation has been performed, and it is determined that the acknowledgement operation has not been performed in other occasions.

When this determination is negative (FIG. 7/STEP 33 . . . NO), the flow returns to STEP 32. On the other hand, when this determination is affirmative (FIG. 7/STEP 33 . . . YES) and the OK button 503 has been pressed, such a work selection screen as illustrated in FIG. 11 is displayed on the on-hand terminal 230 based on the work plan of the operator 2 which is stored in the storage device 12 of the remote operation support server 10 (FIG. 7/STEP 34).

In the case of this work selection screen, work selection buttons 504 to 506 indicating content data of three works which can be performed by the operator 2 are displayed, and a button 507 for returning to the previous screen is displayed in a bottom position. In a frame of each of the work selection buttons 504 to 506, a location of a work site where the work is to be performed, work content, a work schedule, and the like are displayed as the work content data.

Figure 11:
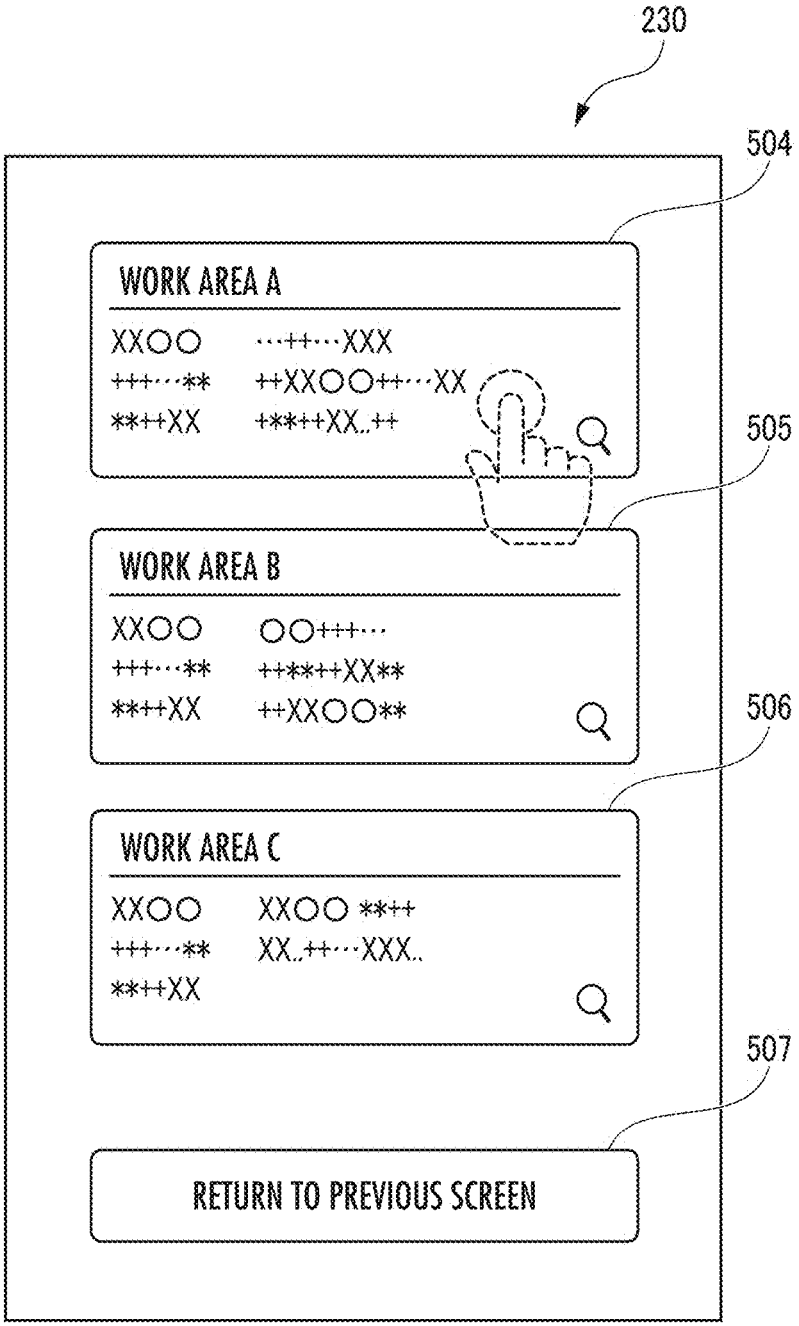
FIG. 11 illustrates an example of a work selection screen.

In the example of the work selection screen illustrated in FIG. 11, the three work selection buttons 504 to 506 are displayed, but depending on the work plan of the operator 2, two or fewer or four or more selection buttons of work content data may be displayed.

Subsequently, it is determined whether or not the work selection has been performed (FIG. 7/STEP 35). In this case, when any of the work selection buttons 504 to 506 has been pressed by the operator 2, it is determined that the work selection has been performed, and it is determined that the work selection has not been performed in other occasions. FIG. 11 illustrates a case where the work selection button 504 has been pressed by the operator 2.

Figure 12:
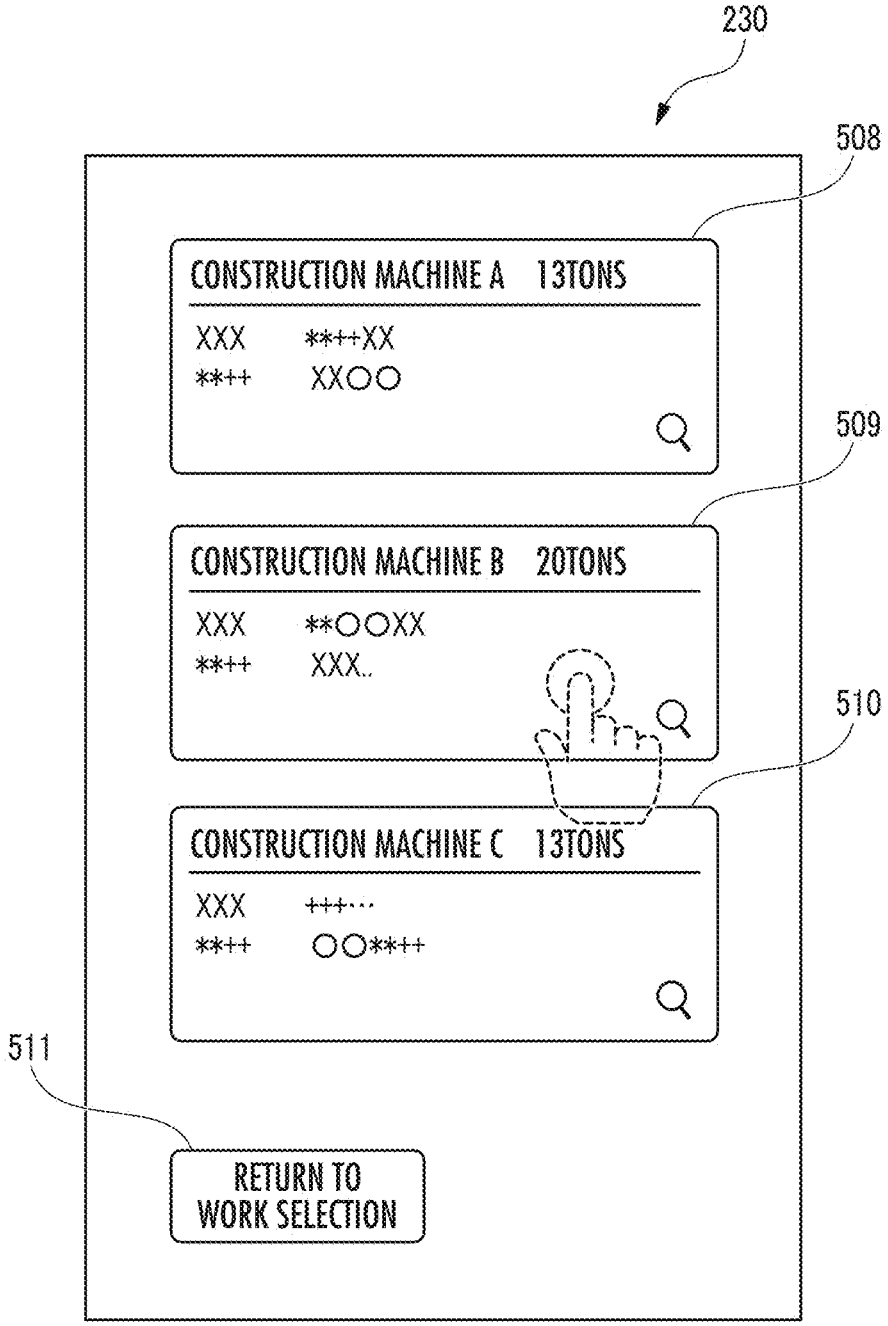
FIG. 12 illustrates an example of a machine selection screen.

When this determination is negative (FIG. 7/STEP 35 . . . NO), the flow returns to STEP 34. On the other hand, when this determination is affirmative (FIG. 7/STEP 35 . . . . YES) and the work selection button has been pressed, such a machine selection screen as illustrated in FIG. 12 is displayed on the on-hand terminal 230 (FIG. 7/STEP 36). Although not illustrated in the drawing, in a case where the button 507 has been pressed, the flow returns to STEP 32.

In the case of this machine selection screen, machine selection buttons 508 to 510 indicating content of three working machines 40 which may be used for the work selected by the operator 2 and which can be remotely operated are displayed, and a button 511 for returning to the work selection is displayed in a bottom position.

For example, in a case where an excavation work to be performed in a work area A has been selected in the work selection (FIG. 7/STEP 35), the working machine 40 present in the work area A which comprises a bucket to be used for excavation and which can be remotely operated is displayed as the machine selection button. On the other hand, the working machine 40 which is not present in the work area A or the working machine 40 which does not comprise the bucket is not displayed. The above processing is realized when the working machine 40 has a unit configured to detect a location such as a GNSS, and when location information of the working machine 40 is received via a network or specification information of the working machine 40 is changed, information of the change is uploaded to the storage device 12 via the network.

In the example of the work selection screen illustrated in FIG. 12, the three machine selection buttons 508 to 510 are displayed, but depending on a situation of the working machine which can be remotely operated, two or fewer or four or more machine selection buttons may be displayed.

Subsequently, it is determined whether or not the machine selection has been performed (FIG. 7/STEP 37). In this case, when any of the machine selection buttons 508 to 510 has been pressed by the operator 2, it is determined that the machine selection has been performed, and it is determined that the machine selection has not been performed in other occasions. FIG. 12 illustrates a case where the machine selection button 509 has been pressed by the operator 2.

Figure 13:
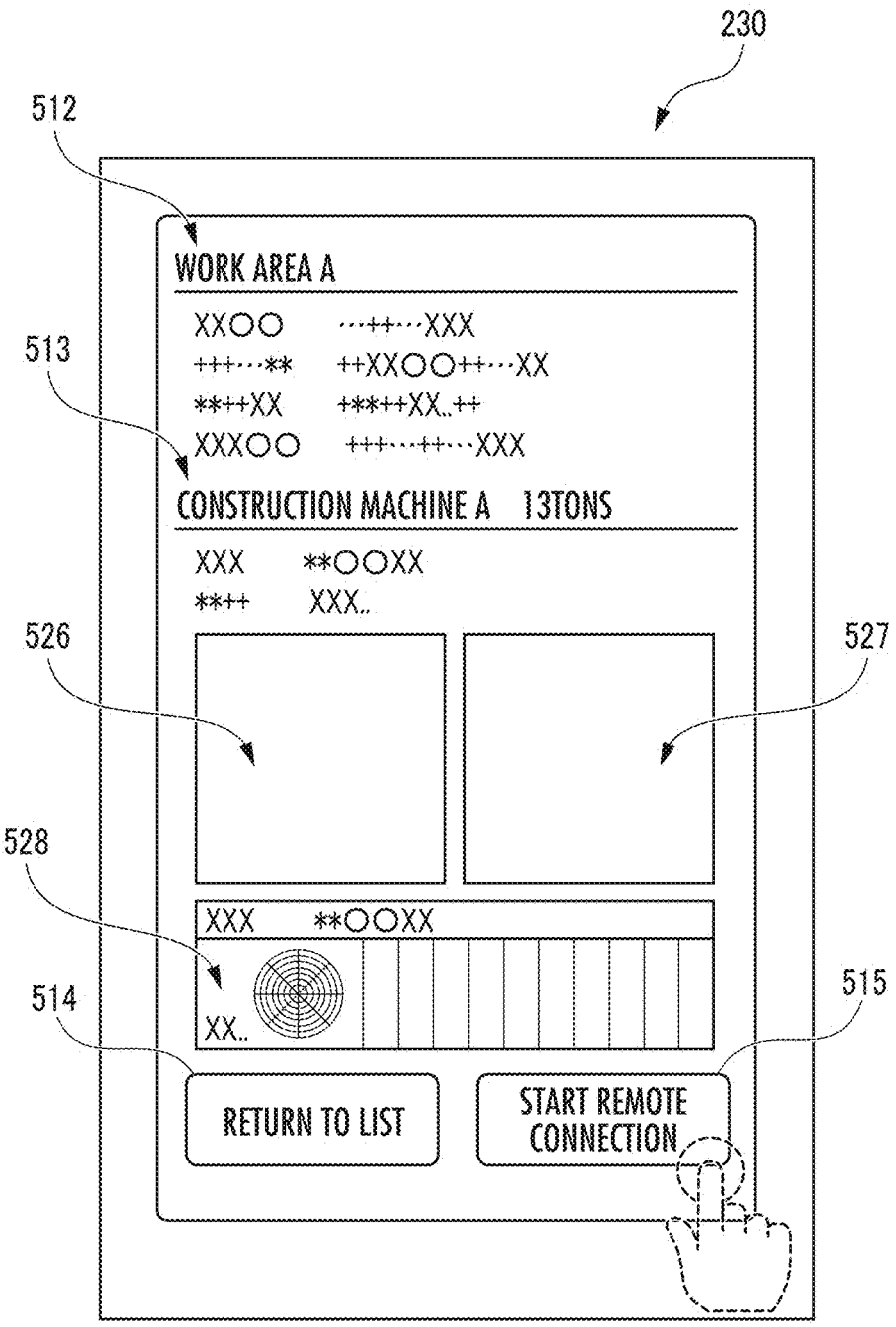
FIG. 13 illustrates an example of a confirmation screen.

When this determination is negative (FIG. 7/STEP 37 . . . NO), the flow returns to STEP 36. On the other hand, when this determination is affirmative (FIG. 7/STEP 37 . . . YES) and the machine selection button has been pressed, such a confirmation screen as illustrated in FIG. 13 is displayed on the on-band terminal 230 (FIG. 7/STEP 38).

In the case of this confirmation screen, data 512 indicating the work content selected by the operator 2 is displayed in a top position, and data 513 indicating the working machine selected by the operator 2 is displayed below the data 512. Photographic data 526 of the working machine 40 selected by the operator 2 and photographic data 527 of the work site where the working machine 40 selected by the operator 2 is located are also displayed below the data 513. These photographic data 526 and 527 are photographic data which have been previously photographed and are saved in the storage device 12.

Weather condition data 528 is further displayed below the photographic data 526 and 527. In this case, current weather condition information (a weather, a temperature, a wind direction) in the work site where the working machine 40 selected by the operator 2 is located and weather forecast information are displayed as the weather condition data 528. The weather condition data 528 is displayed by obtaining the weather condition data corresponding to the location information of the working machine 40 selected by the operator 2.

A button 514 for returning to a list is displayed in a bottom left part of the confirmation screen to return to the previous screen, and a remote operation start button 515 is displayed in a bottom right part of the confirmation screen. In this case, the operator 2 continues a remote operation start work by pressing the remote operation start button 515 in a case where the working machine 40 displayed on the confirmation screen is correct.

On the other hand, the operator 2 can perform an operation to reselect the working machine 40 by pressing the button 514 for returning to the list in a case where the working machine 40 displayed on the confirmation screen is incorrect. Although not illustrated in the drawing, in a case where the button 514 for returning to the list has been pressed by the operator 2, the flow returns to STEP 36.

Subsequently, it is determined whether or not a remote operation start operation has been performed (FIG. 7/STEP 39). In this case, when the remote operation start button 515 has been pressed by the operator 2, it is determined that the remote operation start operation has been performed, and it is determined that the remote operation start operation has not been performed in other occasions.

When this determination is negative (FIG. 7/STEP 39 . . . NO), the flow returns to STEP 38. On the other hand, when this determination is affirmative (FIG. 7/STEP 39 . . . YES) and the remote operation start button 515 has been pressed, an instruction signal is output to the remote operation support server 10 (FIG. 7/STEP 40). Thereafter, the present processing ends. This instruction signal is used to request the remote operation support server 10 for various communication setting information.

With reference to FIG. 5 again, as described above, after the authentication result confirmation processing has been executed in the remote operation apparatus 20, in a case where the instruction signal has been received by the remote operation support server 10, communication connection establishment processing is executed in the remote operation support server 10 (FIG. 5/STEP 4).

In the communication connection establishment processing, to establish a communication connected state between the remote operation apparatus 20 and the working machine 40 selected by the operator 2, an apparatus side communication setting signal is output to the remote operation apparatus 20, and at the same time, a real machine side communication setting signal is output to the working machine 40.

This apparatus side communication setting signal is configured to include various communication setting information such as an IP address of the real machine wireless communication apparatus 470 in the working machine 40 selected by the operator 2, and the real machine wireless communication apparatus 470 can obtain information of the remote wireless communication apparatus 260 where the communication is to be established as the sending destination of various information.

The real machine side communication setting signal is configured to include various communication setting information such as an IP address of the remote wireless communication apparatus 260 in the remote operation apparatus 20 operated by the operator 2, and the remote wireless communication apparatus 260 can obtain information of the real machine wireless communication apparatus 470 where the communication is to be established as a sending destination of various information.

In this case, the remote wireless communication apparatus 260 where communication may be established as the sending destination of various information by the real machine wireless communication apparatus 470 may include a plurality of remote wireless communication apparatuses, and the real machine wireless communication apparatus 470 where communication may be established as the sending destination of various information by the remote wireless communication apparatus 260 may include a plurality of real machine wireless communication apparatuses. For this reason, the remote wireless communication apparatus 260 outputs the apparatus side communication setting signal including various communication setting information such as the IP address where the communication is to be established as the sending destination of various information to the remote operation apparatus 20, and the real machine wireless communication apparatus 470 outputs the real machine side communication setting signal including various communication setting information such as the IP address where the communication is to be established as the sending destination of various information to the working machine 40, so that the remote wireless communication apparatus 260 and the real machine wireless communication apparatus 470 are configured to be able to obtain the information with regard to the sending destination of various information.

As described above, after the communication connection establishment processing has been executed in the remote operation support server 10, in a case where the apparatus side communication setting signal has been received by the remote operation apparatus 20, communication setting processing is executed in the remote operation apparatus 20 (FIG. 5/STEP 5). In this communication setting processing, various communication setting information such as the IP address of the real machine wireless communication apparatus 470 is applied to the remote control apparatus 200.

On the other hand, in a case where the real machine side communication setting signal has been received by the working machine 40, the communication setting processing is executed in the working machine 40 (FIG. 5/STEP 6). In this communication setting processing, various communication setting information such as the IP address of the remote wireless communication apparatus 260 is applied to the real machine control apparatus 400. As described above, by executing the communication setting processing in the remote operation apparatus 20 and the working machine 40, the communication connected state with the working machine 40 is established, and thus, the communication between those can be performed.

As a result of the above, in the working machine 40, it becomes possible to transmit the information such as the image capture data signal including the image capture data captured by the image capture apparatus 461 to the remote wireless communication apparatus 260 at the sending destination, and in the remote operation apparatus 20, it becomes possible to transmit the information such as the operation information including the operation information of the lever which has been performed in the remote operation mechanism 211 to the real machine wireless communication apparatus 470 at the sending destination.

That is, in a case where the working machine 40 has been selected by the operator 2, an instruction signal for requesting various communication setting information is transmitted from the remote operation apparatus 20 to the remote operation support server 10, and various communication setting information such as the IP address is transmitted from the storage device 12 of the remote operation support server 10 to the real machine wireless communication apparatus 470 based on the instruction signal to execute the communication setting processing in the remote operation apparatus 20 and the working machine 40, so that the communication connected state with the working machine 40 is established. Therefore, it takes time since the selection of the working machine 40 by the operator 2 until the establishment of the communication connected state.

After the above-mentioned communication setting processing has been executed to establish the communication connected state, real machine connection preparation processing is executed in the remote operation apparatus 20 (FIG. 5/STEP 7).

Figure 8:
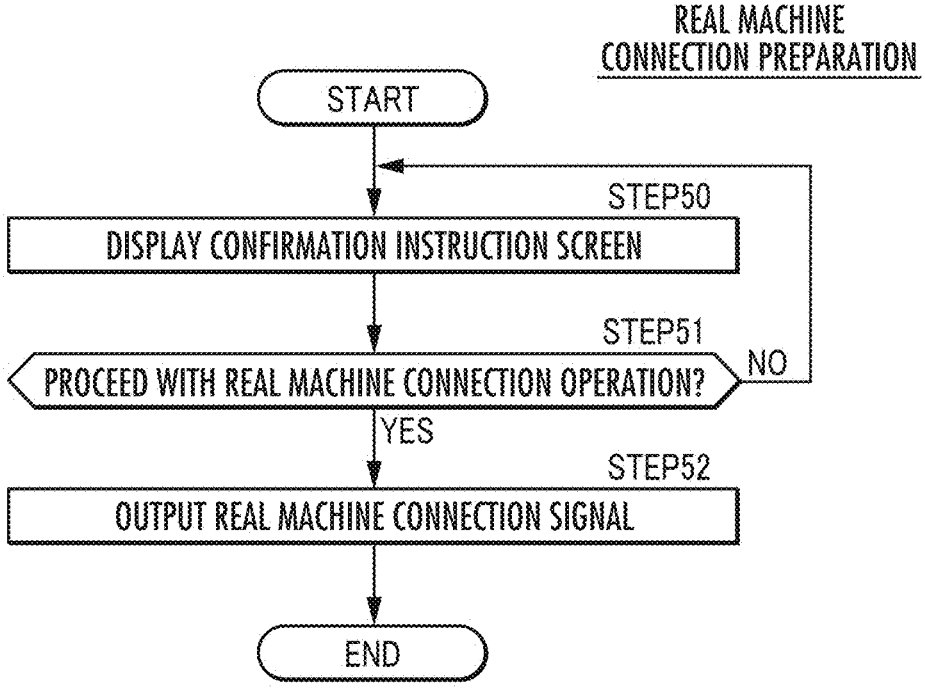
FIG. 8 is a flowchart illustrating real machine connection preparation processing.
Figure 14:
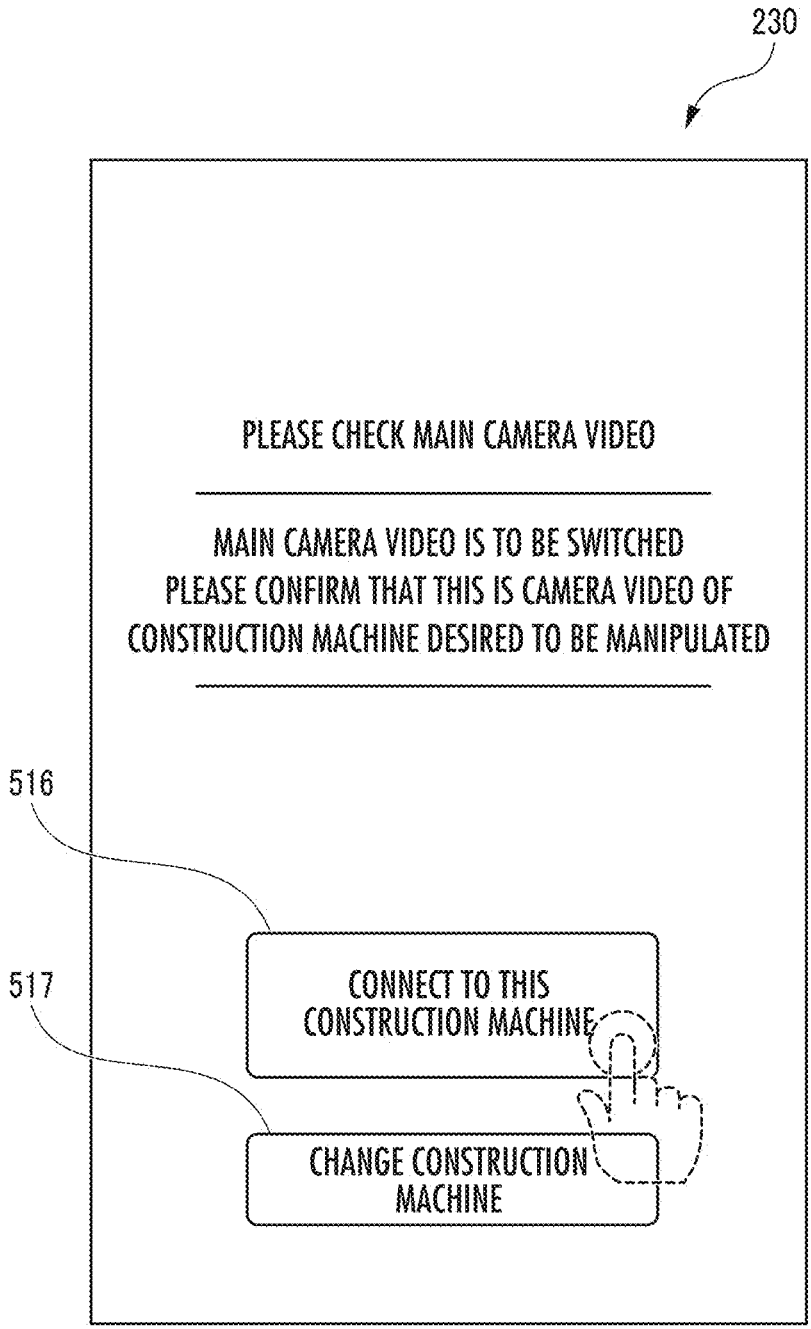
FIG. 14 illustrates an example of a confirmation instruction screen.

This real machine connection preparation processing is specifically executed as illustrated in FIG. 8. As illustrated in the same drawing, first, display processing of a confirmation instruction screen is executed (FIG. 8/STEP 50). In this display processing of the confirmation instruction screen, a confirmation instruction screen illustrated in FIG. 14 is displayed on the on-hand terminal 230.

As illustrated in the same drawing, a message "please check main camera image" is displayed in an upper part of this confirmation instruction screen, and two messages "main camera image is to be switched" and "please confirm that this is camera image of construction machine desired to be manipulated" are displayed in a lower part of the confirmation instruction screen. A connection button 516 in which a message "connect to this construction machine" is displayed and a construction machine change button 517 in which a message "change construction machine" is displayed are further displayed below the above-mentioned messages from the top in the stated order.

This connection button 516 is a button to confirm start of the work with the working machine 40 after the communication connection establishment processing has been executed in the remote operation support server 10. The construction machine change button 517 is a button to cancel the work with the working machine 40 immediately before the work is to be started with the working machine 40 and to reselect a different working machine 40 after the communication connection establishment processing has been executed in the remote operation support server 10.

In addition, although not illustrated in the drawing, at the same time of the display of the confirmation screen on the on-hand terminal 230, in the working machine 40, the image capture data signal including the image capture data captured by the image capture apparatus 461 is output from the real machine control apparatus 400 to the remote operation apparatus 20, and the image capture data captured by the image capture apparatus 461 is output from the image output apparatus 221. In this case, it is possible for the operator 2 to conform, based on the confirmation screen displayed on the on-band terminal 230 and the image capture data displayed on the image output apparatus 221, whether or not the selected working machine 40 is a working machine intended to be remotely operated.

In response to the message, the operator 2 determines whether or not the image capture data displayed on the image output apparatus 221 is correct, and in a case where the working machine 40 is a correct working machine, the remote operation is started by pressing the connection button 516. On the other hand, in a case where the working machine 40 is an incorrect working machine, the working machine 40 is reselected by pressing the construction machine change button 517.

Next, the operator 2 determines whether or not a real machine connection operation has been performed (FIG. 8/STEP 51). In this case, when the connection button 516 of the confirmation instruction screen has been pressed by the operator 2, it is determined that the real machine connection operation has been performed, and it is determined that the real machine connection operation has not been performed in other occasions.

When this determination is negative (STEP 51 . . . . NO), the flow returns to STEP 50. On the other hand, when this determination is affirmative (STEP 51 . . . YES) and the connection button 516 has been pressed, a real machine connection signal is output to the working machine 40 (FIG. 8/STEP 52). Thereafter, the present processing ends. Although not illustrated in the drawing, in a case where the construction machine change button 517 has been pressed, the flow returns to the processing in FIG. 7/STEP 36, and such a machine selection screen as illustrated in FIG. 12 is displayed.

With reference to FIG. 5 again, following the above real machine connection preparation processing, key on operation processing is executed (FIG. 5/STEP 8). In this key on operation processing, along with an operation of the key switch 240 by the operator 2 from the key off position to the key on position, a key on signal representing the key on state is output to the working machine 40.

As described above, after the key on operation processing has been executed in the remote operation apparatus 20, in a case where the key on signal has been received by the working machine 40, in the working machine 40, power source key on processing is performed (FIG. 5/STEP 9). In this power source key on processing, the power source is supplied to the electronic device including the electric circuit configured to start the engine 460 mounted to the working machine 40 based on the key on signal.

Following the above-mentioned key on operation processing, work log entry processing is further executed in the remote operation apparatus 20 (FIG. 5/STEP 10). In this work log entry processing, when the operator 2 operates the on-hand terminal 230 to enter data of the work log, and thus, a work log signal including data of the entered work log is output to the remote operation support server 10.

In a case where this work log signal has been received by the remote operation support server 10, work log update processing is executed in the remote operation support server 10 (FIG. 5/STEP 11). In this work log update processing, the data of the work log of the operator 2 which is stored in the storage device 12 is updated.

The work log is configured to include information that the work selected on the work selection screen (FIG. 7/STEP 35) by the operator 2 who has succeeded the user authentication in the user authentication processing (FIG. 7/STEP 30) is to be performed by the working machine 40 selected on the machine selection screen (FIG. 7/STEP 36). In addition, the work log is configured to include information of a start time and an end time of the work log update processing, an operation situation of the working machine 40 during execution of the work log update processing, and operation information of the remote operation apparatus 20.

Following the above-mentioned work log entry processing, key start operation processing is further executed in the remote operation apparatus 20 (FIG. 5/STEP 12). In this key start operation processing, along with an operation of the key switch 240 by the operator 2 from the key on position to the key start position, a key start signal representing the key start state is output to the working machine 40.

As described above, after the key start operation processing has been executed in the remote operation apparatus 20, in a case where the key start signal has been received by the working machine 40, in the working machine 40, engine start processing is executed (FIG. 5/STEP 12). In this engine start processing, the engine 460 of the working machine 40 is started by the real machine control apparatus 400. When the engine 460 has started, an engine start signal representing the engine start state is output to the remote operation apparatus 20.

As described above, after the engine start processing has been executed in the working machine 40, in a case where the engine start signal has been received by the remote operation apparatus 20, remote operation processing is executed since the signal reception in the remote operation apparatus 20 (FIG. 5/STEP 13).

In this remote operation processing, although not illustrated in the drawing, first, the above-mentioned engine start signal is output from at least one of the image output apparatus 221, the on-hand terminal 230, and the speaker 250. Thus, the operator 2 can confirm that the engine 460 has started.

Subsequently, under a condition where a lever lock release operation has been performed, along with the operation of the remote operation apparatus 20 by the operator 2, it becomes possible to remotely operate the operation of the working machine 40. In this case, when the shutoff lever 2113 has been lowered by the operator 2 to the lock position or the release position, it is determined that the lever lock release operation has been performed, and it is determined that the lever lock release operation has not been performed in other occasions.

Next, with reference to FIG. 15, work selection processing will be described. This work selection processing is executed by the remote control apparatus 200 during the execution of the remote operation by the operator 2 and is processing for changing the remotely operated work which is being executed by the operator 2.

Figure 15:
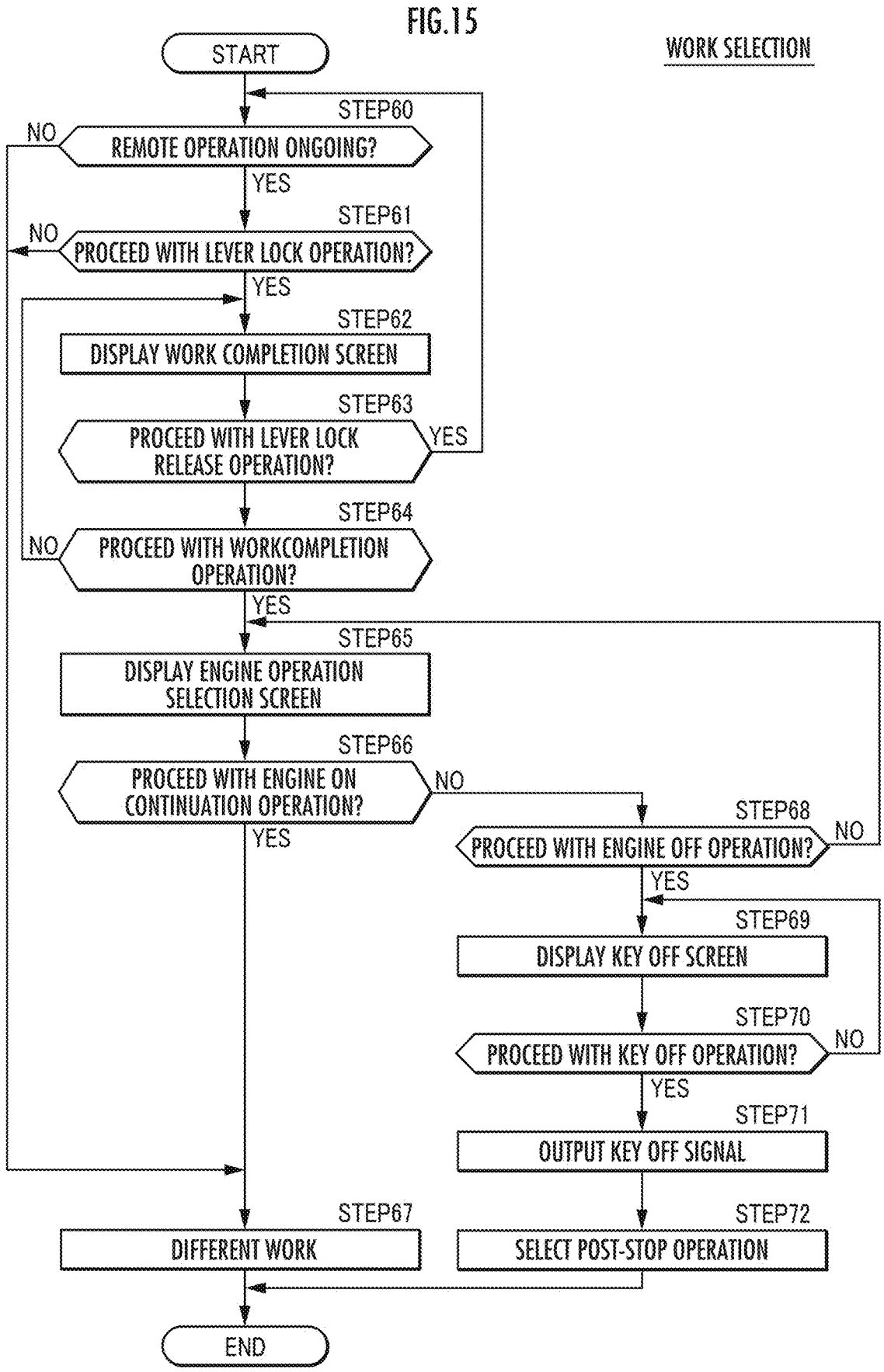
FIG. 15 is a flowchart illustrating work selection processing.

As illustrated in the same drawing, first, it is determined whether or not the remote operation is being performed (FIG. 15/STEP 60). In this case, when the remote operation processing (FIG. 5/STEP 14) is being executed, this determination is affirmative, and in other occasions, this determination is negative. When this determination is negative (FIG. 15/STEP 60 . . . NO), the present processing ends as it is.

On the other hand, when this determination is affirmative (FIG. 15/STEP 60 . . . YES) and the remote operation is being performed, it is determined whether or not a lever lock operation has been performed (FIG. 15/STEP 61). In this case, when the shutoff lever 2113 has been raised to the lock position by the operator 2, it is determined that the lever lock operation has been performed, and it is determined that the lever lock operation has not been performed in other occasions.

Figure 19:
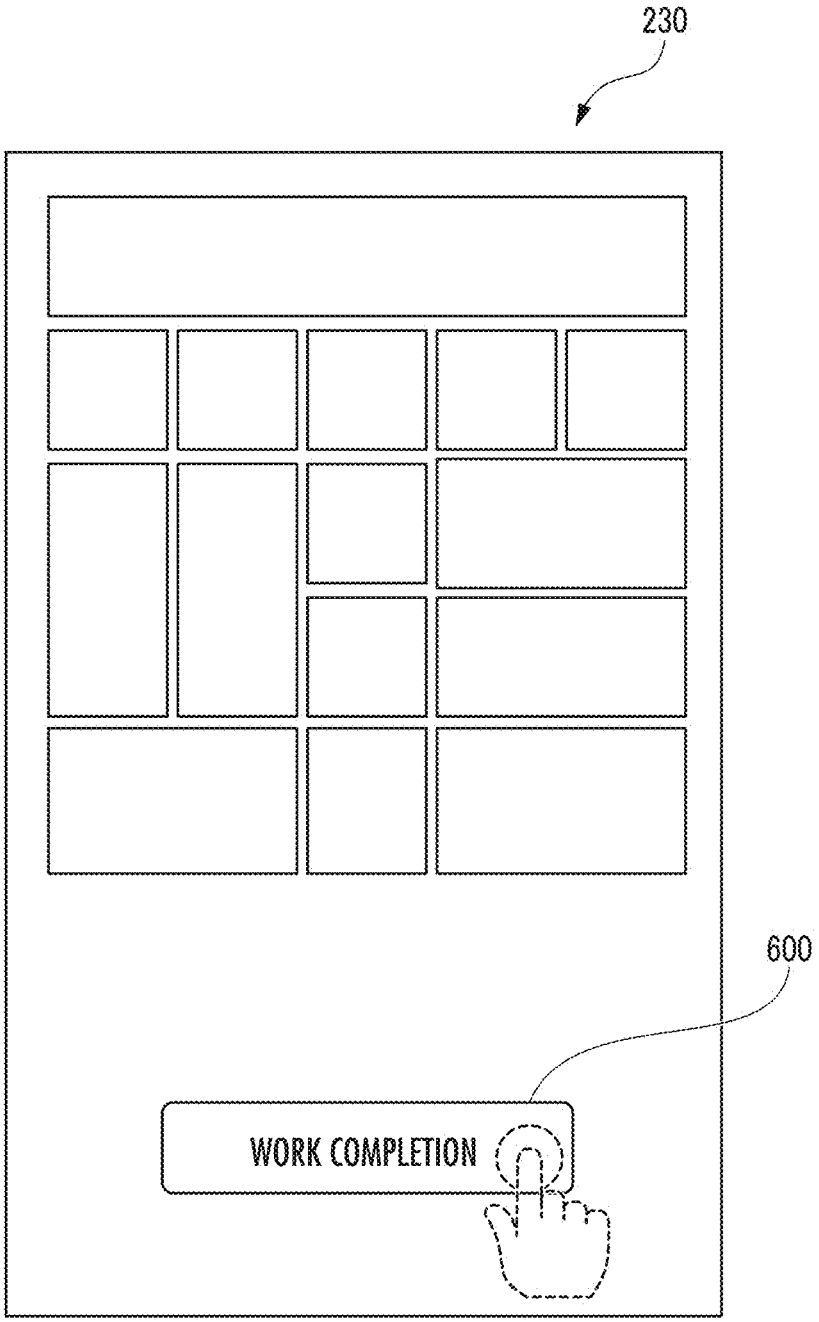
FIG. 19 illustrates a work completion screen.

When this determination is negative (FIG. 15/STEP 61 . . . NO), the present processing ends as it is. On the other hand, when this determination is affirmative (FIG. 15/STEP 61 . . . YES) and the shutoff lever 2113 has been raised to the lock position, a work completion screen illustrated in FIG. 19 is displayed on the on-hand terminal 230 (FIG. 15/STEP 62).

In the case of this work completion screen, data associated with various data of the working machine 40 is displayed from a top part to a central part of the screen, and a work completion button 600 is displayed below the data.

Subsequently, it is determined whether or not the lever lock release operation has been performed (FIG. 15/STEP 63). In this case, when the shutoff lever 2113 has been lowered by the operator 2 from the lock position to the release position, it is determined that the lever lock release operation has been performed, and it is determined that the lever lock release operation has not been performed in other occasions.

When this determination is affirmative (FIG. 15/STEP 63 . . . YES), the flow returns to STEP 60. On the other hand, when this determination is negative (FIG. 15/STEP 63 . . . NO), it is determined whether or not a work completion operation has been performed (FIG. 15/STEP 64). In this case, when the work completion button 600 has been pressed by the operator 2, it is determined that the work completion operation has been performed, and it is determined that the work completion operation has not been performed in other occasions.

When this determination is negative (FIG. 15/STEP 64 . . . . NO), the flow returns to STEP 62. On the other hand, when this determination is affirmative (FIG. 15/STEP 64 . . . YES) and the work completion button 600 has been pressed, an engine operation selection screen is displayed on the on-hand terminal 230. At the same time as this display, although not illustrated in the drawing, the work log update processing which is being executed ends.

Figure 20:
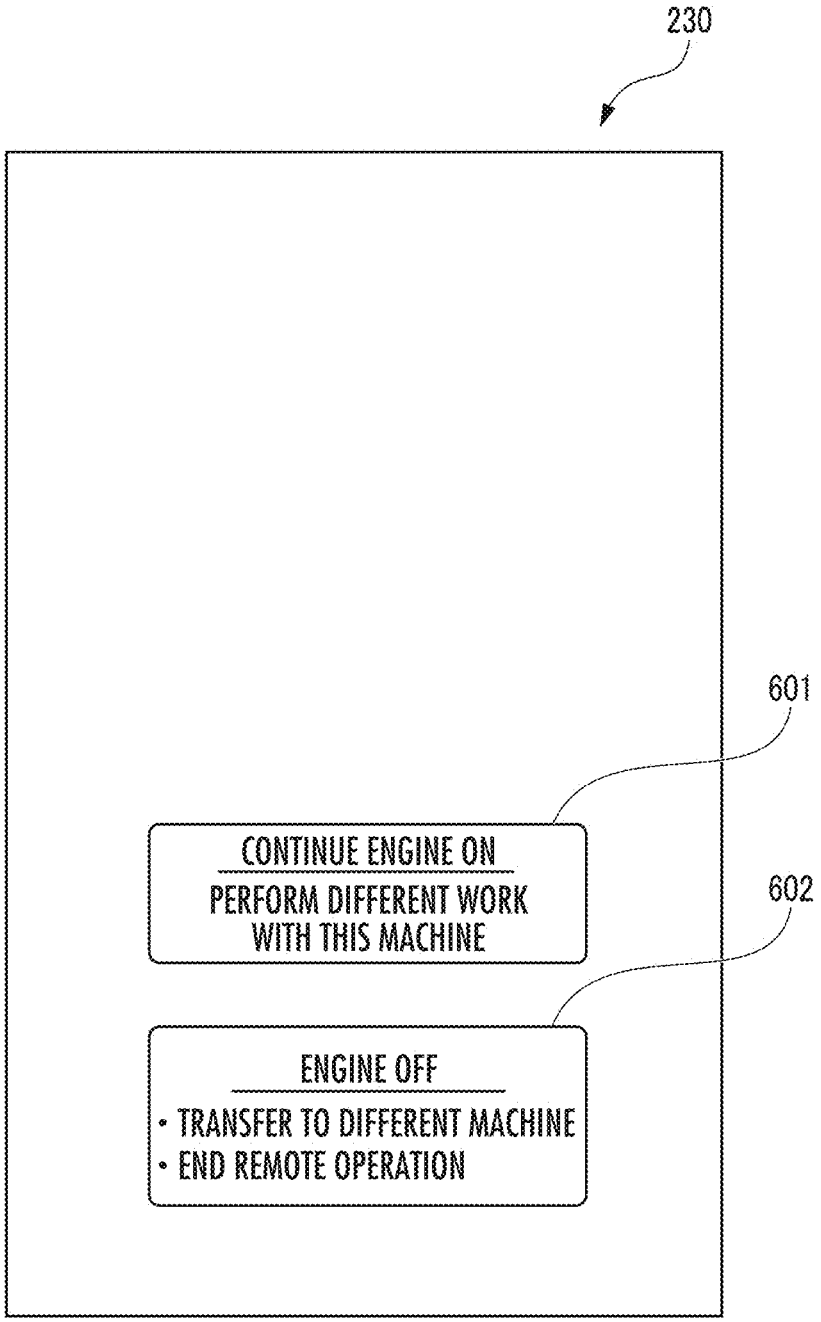
FIG. 20 illustrates an engine operation selection screen.

In the case of this engine operation selection screen, as illustrated in FIG. 20, an engine ON continuation button 601 and an engine OFF button 602 are vertically lined up and displayed in a lower site of the screen. Phrases "continue engine ON" and "perform different work with this machine" are displayed in this engine ON continuation button 601.

This engine ON continuation button 601 is a button to be pressed in a case where, after the work selected on the work selection screen (FIG. 7/STEP 35) has been ended, while the working machine 40 selected on the machine selection screen (FIG. 7/STEP 36) is continuously used, a work different from the work selected on the work selection screen (FIG. 7/STEP 35) is to be selected. Phrases "engine OFF", "• transfer to different machine" and "• end remote operation" are displayed in the engine OFF button 602.

Subsequently, it is determined whether or not an engine ON continuation operation has been performed (FIG. 15/STEP 66). In this case, when the engine ON continuation button 601 has been pressed by the operator 2, it is determined that the engine ON continuation operation has been performed, and it is determined that the engine ON continuation operation has not been performed in other occasions.

When this determination is affirmative (FIG. 15/STEP 66 . . . YES) and the engine ON continuation button 601 has been pressed, different work processing is performed (FIG. 15/STEP 67).

In this different work processing, after the processing in STEPS 34 and 35 in FIG. 7 described above has been executed and the different work has been selected, the remote operation processing in STEP 14 of FIG. 5 described above is executed. As described above, after the different work processing has been executed, the present processing ends.

On the other hand, when the above-described determination is negative (FIG. 15/STEP 66 . . . NO) and the engine ON continuation button 601 has not been pressed, it is determined whether or not engine OFF operation has been performed (FIG. 15/STEP 68).

In this case, when the engine OFF button 602 has been pressed by the operator 2, it is determined that the engine OFF operation has been performed, and it is determined that the engine OFF operation has not been performed in other occasions. This engine OFF button 602 is a button to be pressed in a case where a work is to be performed with a working machine 40 different from the working machine 40 selected on the machine selection screen (FIG. 7/STEP 36) or a case where the remote operation itself in the remote operation apparatus 20 is to be ended.

When this determination is negative (FIG. 15/STEP 68 . . . NO), the flow returns to STEP 65 described above. On the other hand, when this determination is affirmative (FIG. 15/STEP 68 . . . YES) and the engine OFF button 602 has been pressed, a key off screen illustrated in FIG. 21 is displayed on a part of the image output apparatus 221 (FIG. 15/STEP 69).

Figure 21:
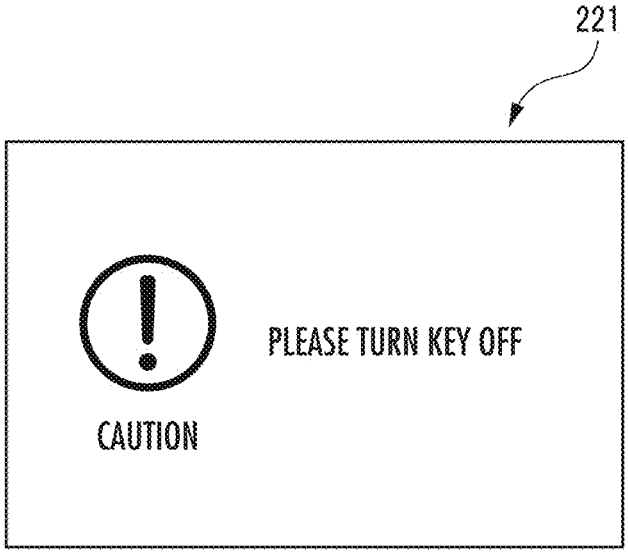
FIG. 21 illustrates a key off screen.

In the case of this key off screen, as illustrated in FIG. 21, a mark "!" surrounded by a circle is displayed on the left side of the screen, and a text "caution" is displayed below the mark. In addition, a text "please turn key off" is displayed on the left side of the mark. Since the communicated and connected working machine 40 is put into an unused state, these mark and texts are displayed so as to stop the engine of the working machine 40.

Subsequently, it is determined whether or not a key off operation has been performed (FIG. 15/STEP 70). In this case, when the key switch 240 has been operated by the operator 2 from the key on position to the key off position, it is determined that the key off operation has been performed, and it is determined that the key off operation has not been performed in other occasions.

When this determination is negative (FIG. 15/STEP 70 . . . . NO), the flow returns to STEP 68. On the other hand, when this determination is affirmative (FIG. 15/STEP 70 . . . YES) and the off operation of the key switch 240 has been performed, an engine stop signal is output (transmitted) to the working machine 40 (FIG. 15/STEP 71). As described above, in this work selection processing, when a change operation of the key switch 240 in the remote operation apparatus 20 has been performed by the operator 2 from the key on position to the key off position, a key off signal is transmitted to the working machine 40. On the other hand, the key off signal is not transmitted to the working machine 40 in other occasions.

Figure 17:
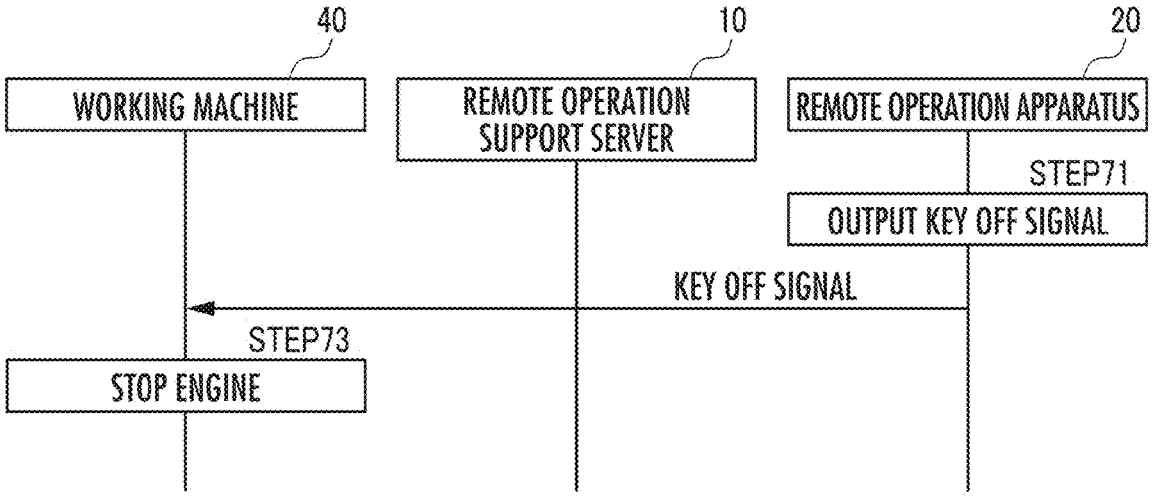
FIG. 17 is a sequence diagram illustrating control processing at the time of output of an engine stop signal.

In a case where this key off signal has been received by the working machine 40, as illustrated in FIG. 17, engine stop processing is executed in the working machine 40 (FIG. 17/STEP 73). Thus, the engine 460 is stopped.

With reference to FIG. 15 again, after the key off signal is output to the working machine 40, post-stop operation selection processing is executed (FIG. 15/STEP 72). This post-stop operation selection processing is specifically executed as illustrated in FIG. 16.

Figure 16:
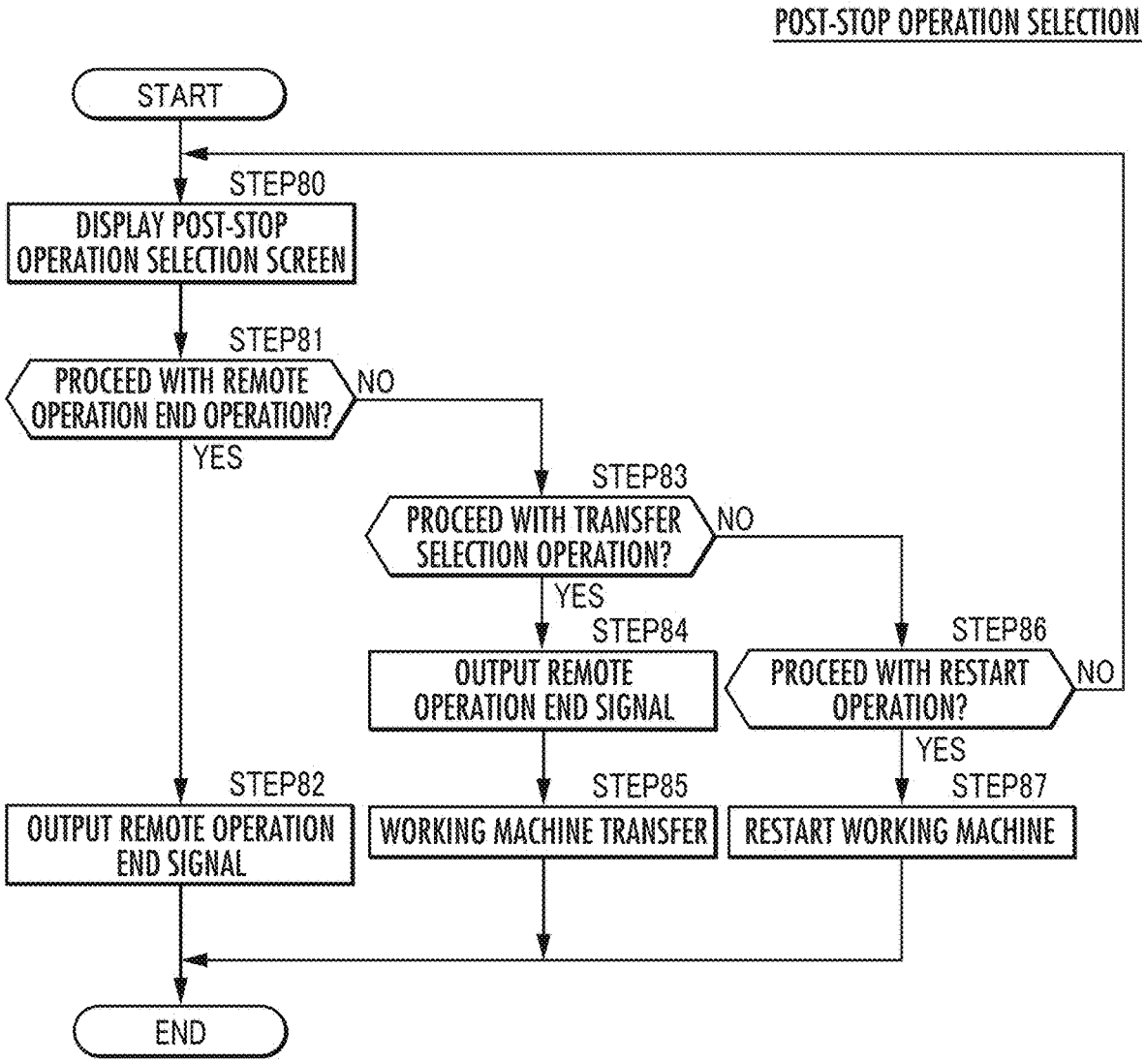
FIG. 16 is a flowchart illustrating post-stop operation selection processing.
Figure 22:
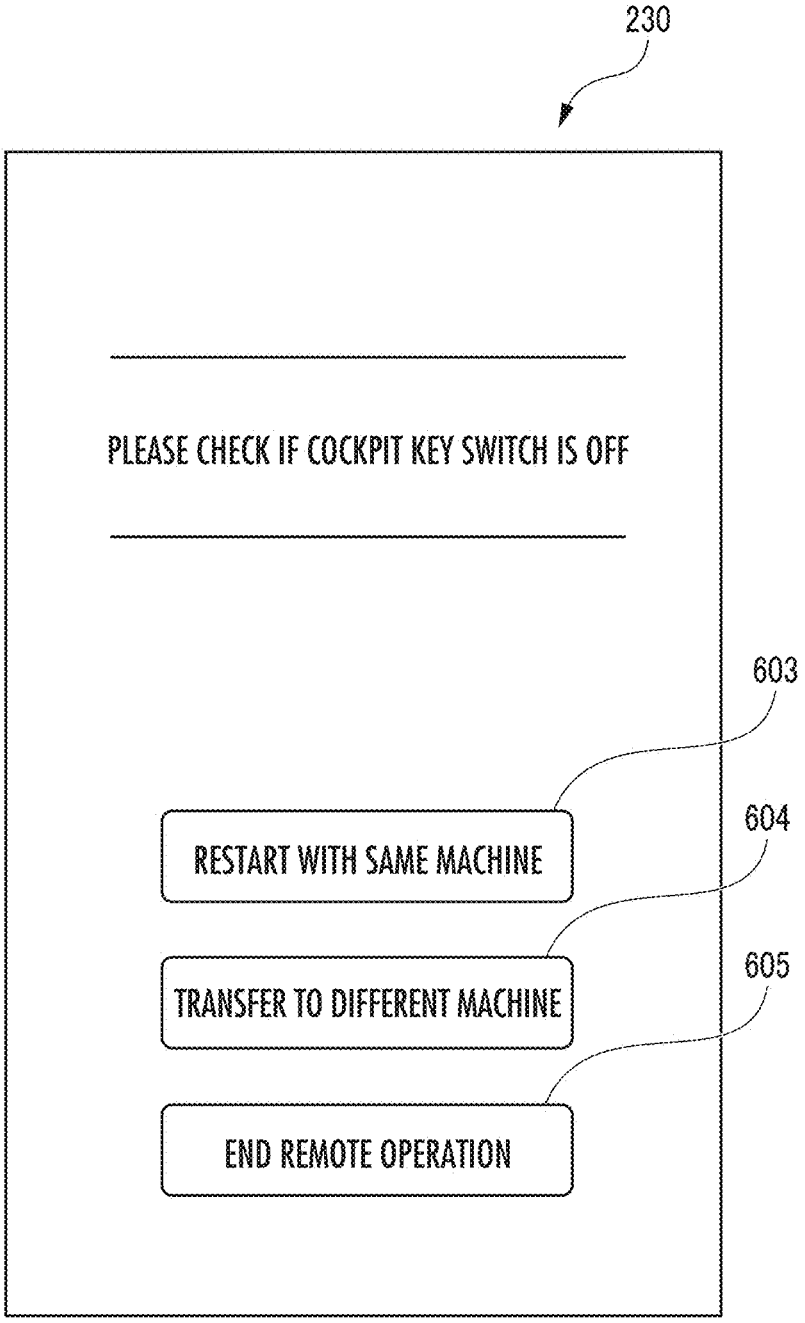
FIG. 22 illustrates a post-stop operation selection screen.

As illustrated in the same drawing, in this processing, first, a post-stop operation selection screen illustrated in FIG. 22 is displayed on the on-band terminal 230 (FIG. 16/STEP 80). In the case of this post-stop operation selection screen, as illustrated in FIG. 22, a text "please check if cockpit key switch is OFF" is displayed on the upper part of the screen. This text is displayed to restrict the operator 2 from operating the key switch 240 to the key on position or the key start position.

In addition, a restart button 603, a machine transfer button 604, and a remote operation end button 605 are displayed in the stated from the top below the above-mentioned text display.

A text "restart with same model" is displayed in this restart button 603. A text "transfer to different machine" is displayed in the machine transfer button 604. A text "end remote operation" is displayed in the remote operation end button 605. In the case of the present embodiment, the display of the post-stop operation selection screen on the on-hand terminal 230 is equivalent to the output of confirmation information by the remote input unit.

Subsequently, it is determined whether or not a remote operation end operation has been performed (FIG. 16/STEP 81). In this case, when the remote operation end button 605 has been pressed by the operator 2, it is determined that the remote operation end operation has been performed, and it is determined that the remote operation end operation has not been performed in other occasions. In the case of the present embodiment, the press of the remote operation end button 605 by the operator 2 is equivalent to the specified operation for executing the end of the remote operation.

When this determination is affirmative (FIG. 16/STEP 81 . . . YES) and the remote operation end button 605 has been pressed, a remote operation end signal is output to the remote operation support server 10 (FIG. 16/STEP 82). This remote operation end signal is a signal for commanding the remote operation support server 10 to end the remote operation from the remote operation apparatus 20. Thereafter, the present processing ends.

Figure 18:
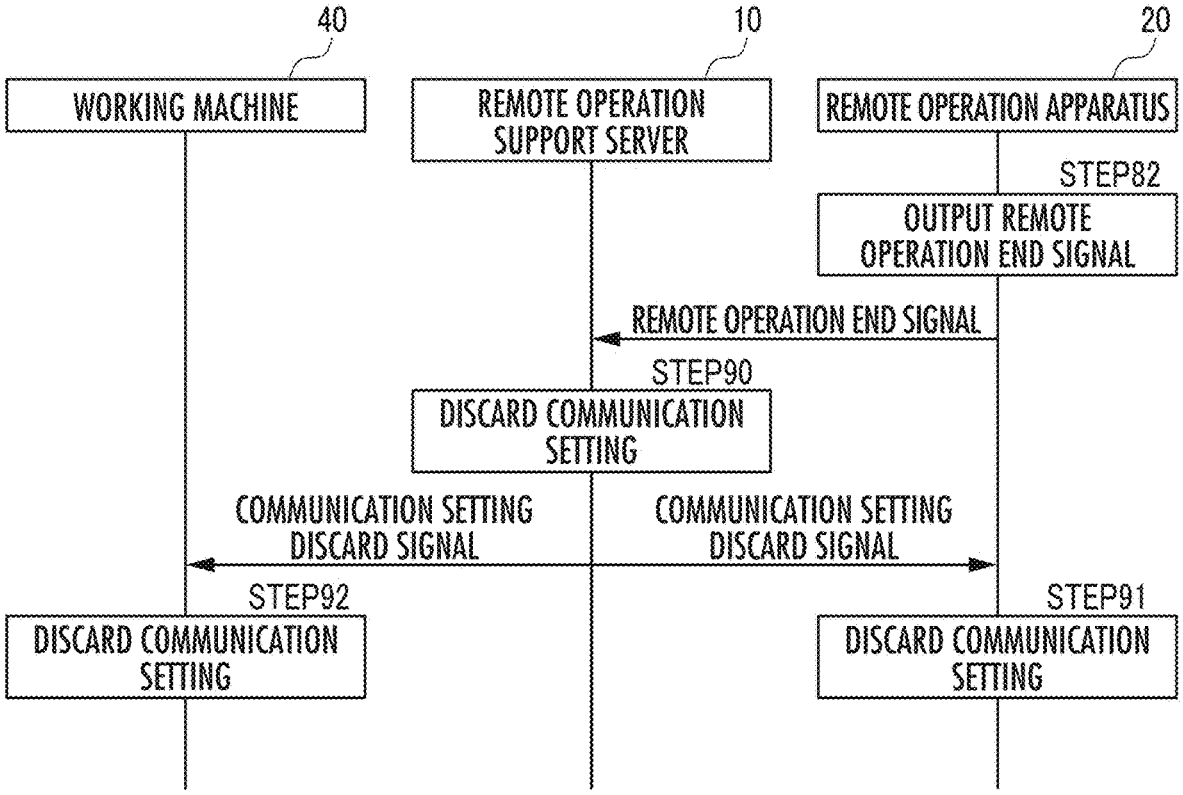
FIG. 18 is a sequence diagram illustrating control processing at the time of output of a remote operation end signal.

In a case where this engine stop signal has been received by the remote operation support server 10, as illustrated in FIG. 18, communication setting discard processing is executed in the remote operation support server 10 (FIG. 18/STEP 90). Along with the execution, a communication setting discard signal is output from the remote operation support server 10 to the remote operation apparatus 20 and the working machine 40.

In a case where this communication setting discard signal has been received by the remote operation apparatus 20, the communication setting discard processing is executed (FIG. 18/STEP 91). In this communication setting discard processing, the above-described various communication setting information set in the remote control apparatus 200 is discarded.

In a case where the communication setting discard signal has been received by the working machine 40, the communication setting discard processing is executed (FIG. 18/STEP 92). In this communication setting discard processing, the above-described various communication setting information set in the real machine control apparatus 400 is discarded. As a result of the above, a state is established in which the wireless communication connection between the remote control apparatus 200 and the working machine 40 has been disconnected.

With reference to FIG. 16 again, when the above-described determination is negative (FIG. 16/STEP 81 . . . NO) and the remote operation end button 605 has not been pressed, it is determined whether or not a transfer selection operation has been performed (FIG. 16/STEP 83). In this case, when the machine transfer button 604 has been pressed by the operator 2, it is determined that the transfer selection operation has been performed, and it is determined that the transfer selection operation has not been performed in other occasions. In the case of the present embodiment, the press of the machine transfer button 604 is equivalent to a real machine switch operation.

When this determination is affirmative (FIG. 16/STEP 83 . . . YES) and the machine transfer button 604 has been pressed, the above-described remote operation end signal is output to the remote operation support server 10

(FIG. 16/STEP 84). Thus, the communication setting discard processing in FIG. 18 described above is executed.

Subsequently, working machine transfer processing is executed (FIG. 16/STEP 85), and thereafter, the present processing ends. In this working machine transfer processing, in the remote operation apparatus 20, the processing in STEPS 22 to 25 of FIG. 6 in the processing in STEP 1 of FIG. 5 is executed, and the processing in STEP 3 and subsequent steps is executed.

At the same time as the above-described processing, in the remote operation support server 10 too, the processing in STEP 2 and subsequent steps of FIG. 5 described above is executed, and in the working machine 40 too, the processing in STEP 6 and subsequent steps of FIG. 5 described above is executed. This working machine transfer processing is for switching the working machine 40 to be remotely operated by the operator 2 to a different working machine.

On the other hand, when the above-mentioned determination is negative (FIG. 16/STEP 83 . . . NO) and the machine transfer button 604 has not been pressed, it is determined whether or not a restart operation has been performed (FIG. 16/STEP 86). In this case, when the restart button 603 has been pressed by the operator 2, it is determined that the restart operation has been performed, and it is determined that the restart operation has not been performed in other occasions.

When this determination is negative (FIG. 16/STEP 86 . . . NO), the flow returns to STEP 80 described above. On the other hand, when this determination is affirmative (FIG. 16/STEP 86 . . . YES) and the restart button 603 has been pressed, working machine restart processing is executed (FIG. 16/STEP 87), and thereafter, the present processing ends.

In this working machine restart processing, in the remote operation apparatus 20, the processing in STEPS 22 to 25 of FIG. 6 in the processing in STEP 1 of FIG. 5 is executed, and the processing in STEP 3 and STEP 7 and subsequent steps is executed. At the same time as the above-described execution, STEP 2 and STEP 11 of FIG. 5 is executed in the processing in the remote operation support server 10, and the processing in STEP 9 and subsequent steps is executed in the working machine 40 too.

As described above, in accordance with the remote operation system 1 of the present embodiment, after the lever lock operation has been performed to stop the working machine 40, unless the remote operation end operation is performed or the transfer selection operation is performed, the communication connection establishment processing is not to be executed again. That is, the communication connected state between the remote operation apparatus 20 and the working machine 40 is maintained. Thus, after the stop of the working machine 40, when the remote operation of the working machine 40 is to be resumed, it is possible to reduce time from when the remote operation is paused to when the remote operation is resumed as compared with a case where the communication connected state between the remote operation apparatus 20 and the working machine 40 is to be established again.

In addition, after the stop of the working machine 40, in a case where the remote operation end operation has been performed or the transfer selection operation has been performed, the communication setting in the remote control apparatus 200 and the real machine control apparatus 400 is discarded, and the communication connected state between the remote operation apparatus 20 and the working machine 40 is ended. Thus, in a highly probable circumstance where the remote operation may be ended, it is possible to reliably end the communication connected state.

Furthermore, by configuring the communication setting for enabling the communication between the remote wireless communication apparatus 260 and the real machine wireless communication apparatus 470 by the remote control apparatus 200 and the real machine control apparatus 400, the communication connected state between the remote operation apparatus 20 and the working machine 40 can be established (STEPS 4 to 6 of FIG. 5). Thus, also under a condition where the plurality of remote operation apparatuses 20 is present and the plurality of working machines 40 which can be remotely operated by these remote operation apparatuses is present, it is possible to appropriately establish the communication connected state between the remote operation apparatus 20 and the working machine 40 which is to be subjected to the remote operation of the remote operation apparatus 20.

In addition, after the working machine 40 has been stopped, since the engine 460 is stopped by the operator 2, to confirm with the operator 2 as to whether or not resumption or end of the remote operation is allowed to be performed, the post-stop operation selection screen is displayed on the on-hand terminal 230 (FIG. 22). Thus, the operator 2 can accurately decide whether or not the resumption or the end of the remote operation is allowed to be performed by operating the on-hand terminal 230.

Furthermore, since the engine 460 is stopped before the post-stop operation selection screen is displayed on the on-hand terminal 230, it is possible to avoid wasteful consumption of fuel by the engine 460.

In addition, in a case where the machine transfer button 604 has been pressed on the post-stop operation selection screen, since the working machine transfer processing is executed, the transfer operation of the working machine 40 can be accurately executed. Furthermore, in a case where the restart button 603 has been pressed on the post-stop operation selection screen, the working machine restart processing is executed. In this working machine restart processing and the working machine transfer processing, the authentication processing of the operator 2 is executed. Thus, it is possible to check whether or not the operator 2 who is to resume the remote operation matches the registered operator saved in the storage device 12. This is based on that the latest operation by the remote operation is in a completed state in a state in which the post-stop operation selection screen is displayed on the on-hand terminal 230, and the operator 2 who has performed the remote operation may be replaced with the other operator 2, so that it is necessary to execute the authentication processing of the operator 2 after the resumption of the remote operation.

Furthermore, since the on-band terminal 230 is installed in a vicinity of the seat 231, the operator 2 can perform the input operation to the on-band terminal 230 in a seated state on the seat 231.

The embodiment is an example in which the working machine 40 of the crawler shovel type is used as the working machine, but the working machine of the present invention is not limited to this, and any machine may be used as long as the remote operation can be performed by the remote operation apparatus. For example, as the working machine, a crane or the like which can be remotely operated may be used.

In addition, the embodiment is an example in which the on-hand terminal 230 is used as the remote input unit, but the remote input unit of the present invention is not limited to this, and any remote input unit may be used as long as the operation can be performed by the operator. For example, a mobile terminal of a smart phone type may be used as the remote input unit.

Furthermore, the embodiment is an example in which the press of the button by the operator 2 is used as the specified operation, but instead of this, input of a speech by the operator 2 to an apparatus such as the on-hand terminal 230 may be used as the specified operation.

In addition, in the remote operation system 1, only any one of the remote operation support server 10, the remote operation apparatus 20, and the working machine 40 may be configured to comprise the functions as the remote control element and the communication control element. That is, only any one of the remote operation support server 10, the remote operation apparatus 20, and the working machine 40 may constitute the remote operation system 1.

For example, in a case where the remote operation apparatus 20 constitutes the remote operation system 1, the remote control apparatus 200 may comprise the respective functions of the remote control element and the communication control element. Similarly, in a case where the working machine 40 constitutes the remote operation system 1, the real machine control apparatus 400 may comprise the respective functions of the remote control element and the communication control element.

Furthermore, in the remote operation system 1, one of the remote operation support server 10 and the remote operation apparatus 20 may be configured to comprise the function as the remote control element, and the other one of the remote operation support server 10 and the remote operation apparatus 20 may be configured to comprise the function as the communication control element.

In addition, in the remote operation system 1, one of the remote operation support server 10 and the working machine 40 may be configured to comprise the function as the remote control element, and the other one of the remote operation support server 10 and the working machine 40 may be configured to comprise the function as the communication control element.

Furthermore, in the remote operation system 1, one of the remote operation apparatus 20 and the working machine 40 may be configured to comprise the function as the remote control element, and the other of the remote operation apparatus 20 and the working machine 40 may be configured to comprise the function as the communication control element.

In accordance with the remote operation system of the present invention, when the remote operation is to be resumed after the stop operation of the working machine has been executed, since the communication connected state is maintained during a period until the execution of the specified operation, it is possible to reduce time from when the remote operation is paused to when the remote operation is resumed as compared with a case where the communication connected state is established again.

In addition, according to the present invention, after execution of a real machine stop operation, when the specified operation for ending the remote operation has been executed in the remote input unit by the operator, the communication control element preferably ends the communication connected state.

In accordance with this remote operation system, since the specified operation for ending the remote operation is executed by the operator, it is possible to confirm that the remote operation by the remote operation apparatus may be ended for the working machine remotely operated by the remote operation apparatus. Thus, in a highly probable circumstance where the remote operation may be ended, it is possible to reliably end the communication connected state.

In addition, according to the present invention, the communication control element comprises an apparatus side communication control element configured to control an apparatus side communication apparatus in the remote operation apparatus, and a real machine side communication control element configured to control a real machine side communication apparatus in the working machine, and the apparatus side communication control element and the real machine side communication control element preferably establish the communication connected state by configuring a communication setting which enables communication between the apparatus side communication apparatus and the real machine side communication apparatus.

In accordance with this remote operation system, the apparatus side communication control element and the real machine side communication control element can establish the communication connected state between the remote operation apparatus and the working machine by configuring the communication setting for enabling the communication between the apparatus side communication apparatus and the real machine side communication apparatus. In this case, for example, in such a situation where a plurality of remote operation apparatuses is present and a plurality of working machines which can be remotely operated is present, a plurality of candidates of communication apparatuses which can be communicated by the apparatus side communication apparatus and the real machine side communication apparatus is present. When the communication setting is set in the communication apparatus in which the communication is to be established as described above, it is possible to reliably establish the communication connected state between the remote operation apparatus and the working machine which is to be subjected to the remote operation by the remote operation apparatus.

In addition, according to the present invention, after the execution of the real machine stop operation, when the specified operation for ending the remote operation has been executed in the remote input unit by the operator, the apparatus side communication control element and the real machine side communication control element preferably end maintaining the communication connected state by discarding the communication setting.

In accordance with this remote operation system, when the specified operation for ending the remote operation is executed by the operator, the working machine remotely operated by the remote operation apparatus can confirm that the remote operation by the remote operation apparatus may be ended. Thus, in a highly probable circumstance where the remote operation may be ended, the communication setting can be discarded.

In addition, according to the present invention, the remote operation system preferably further comprises an output control element configured to cause a remote output unit of the remote operation apparatus to output the confirmation information for confirming with the operator as to whether or not the resumption or the end of the remote operation is allowed to be performed when the real machine stop operation has been executed.

In accordance with this remote operation system, when the real machine stop operation has been executed, the confirmation information for confirming with the operator as to whether or not the resumption or the end of the remote operation is allowed to be performed is output from the remote output unit. Thus, the operator can accurately decide whether or not the resumption or the end of the remote operation is allowed to be performed, and can accurately execute the specified operation for specifying the resumption or the end of the remote operation in the remote input unit.

In addition, according to the present invention, after the execution of the real machine stop operation, in a case where an engine stop operation for stopping the internal combustion engine of the working machine has been executed in the remote input unit by the operator, the remote control element preferably stops the internal combustion engine.

In accordance with this remote operation system, since the internal combustion engine has been stopped by the operator after the execution of the real machine stop operation, it is possible to avoid wasteful consumption of fuel by the internal combustion engine.

In addition, according to the present invention, after the execution of the real machine stop operation, in a case where the work end operation and the engine stop operation for stopping the internal combustion engine of the working machine have been executed in the remote input unit by the operator, the remote control element preferably stops the internal combustion engine.

In accordance with this remote operation system, in a highly probable circumstance where the remote operation in which the operation including the engine stop operation is to be executed by the operator has been paused, the internal combustion engine can be stopped, and it is possible to avoid wasteful consumption of fuel by the internal combustion engine since the stop.

In addition, according to the present invention, after the execution of the real machine stop operation, in a case where the real machine switch operation for executing the switch from the working machine to a different working machine has been executed in the remote input unit by the operator, the remote control element preferably executes switch processing to the different working machine.

In accordance with this remote operation system, after the stop of the working machine, when an intention to switch the working machine to be remotely operated to a different working machine has been indicated by the operator, the switch operation can be accurately executed.

In addition, according to the present invention, when switch processing is executed by the remote control element, the communication control element preferably ends the communication connected state between the remote operation apparatus and the working machine.

In accordance with this remote operation system, since the switching processing has been executed, it is possible to confirm that the remote operation by the remote operation apparatus may be ended in the working machine remotely operated by the remote operation apparatus. Thus, in a highly probable circumstance where the remote operation may be ended, it is possible to reliably end the communication connected state.

In addition, according to the present invention, in a case where a predetermined condition including a success in the authentication of the operator as one condition has been met, the remote control element preferably establishes the communication connected state between the remote operation apparatus and the working machine so as to enable the remote operation of the working machine and preferably executes the authentication of the operator before the remote operation is to be resumed.

In accordance with this remote operation system, since the authentication of the operator is executed before the remote operation is to be resumed, it is possible to confirm whether or not the operator who is to resume the remote operation is the same person as the operator before the resumption, and in a case where the operator who is to resume the remote operation is a person different from the operator before the resumption, it is possible to confirm whether or not the operator has an eligibility to perform the remote operation of the working machine.

In addition, according to the present invention, the remote input unit is preferably installed in a vicinity of a seat for the operator to sit on.

In accordance with this remote operation system, the operator can perform an input operation to the remote input unit in a sitting state on the seat.

REFERENCE SIGNS LIST

1 remote operation system
2 operator
20 remote operation apparatus
200 remote control apparatus
201 remote control element
202 communication control element
203 apparatus side communication control element
204 output control element
230 on-hand terminal (remote input unit)
231 seat
260 remote wireless communication apparatus (apparatus side communication apparatus)
40 working machine
400 real machine control apparatus (communication control element, real machine side communication control element)
460 engine (internal combustion engine)
470 real machine wireless communication apparatus (real machine side communication apparatus)

The invention claimed is:

1. A remote operation system for an operator to perform a remote operation of a working machine via a remote operation apparatus with a remote input unit, the remote operation system comprising:

a remote control element configured to execute resumption processing or end processing of the remote operation when a specified operation for executing resumption or end of the remote operation has been executed in the remote input unit by the operator in a case where a working machine stop operation of the working machine has been executed via the remote operation apparatus by the operator during execution of the remote operation; and a communication control element configured to establish a communication connected state between the remote operation apparatus and the working machine such that, when the remote operation is to be started, the remote operation of the working machine is enabled and to maintain the communication connected state during a period between the execution of the working machine stop operation and the specified operation is to be executed, wherein the communication control element comprises a first communication control element configured to control a communication apparatus in the remote operation apparatus, and a second communication control element configured to control a communication apparatus in the working machine, and the first communication control element and the second communication control element establish the communication connected state by configuring a communication setting which enables communication between the first communication apparatus and the second communication apparatus.

2. The remote operation system according to claim 1, wherein after the execution of the working machine stop operation, when the specified operation for ending the remote operation has been executed in the remote input unit by the operator, the communication control element ends the communication connected state.

3. The remote operation system according to claim 1, wherein after the execution of the working machine stop operation, when the specified operation for ending the remote operation has been executed in the remote input unit by the operator, the first communication control element and the second machine side communication control element end maintaining the communication connected state by discarding the communication setting.

4. The remote operation system according to claim 1, further comprising:

an output control element configured to cause a remote output unit of the remote operation apparatus to output confirmation information for confirming with the operator as to whether or not resumption or end of the remote operation is allowed to be performed when the working machine stop operation has been executed.

5. The remote operation system according to claim 1, wherein after the execution of the working machine stop operation, in a case where an internal combustion engine stop operation for stopping an internal combustion engine of the working machine has been executed in the remote input unit by the operator, the remote control element causes the internal combustion engine to stop.

6. The remote operation system according to claim 1, wherein after the execution of the working machine stop operation, in a case where a work end operation and an internal combustion engine stop operation for stopping an internal combustion engine of the working machine have been executed in the remote input unit by the operator, the remote control element causes the internal combustion engine to stop.

7. The remote operation system according to claim 1, wherein after the execution of the working machine stop operation, in a case where a working machine switch operation of switching from the working machine to a different working machine has been executed in the remote input unit by the operator, the remote control element executes switch processing to the different working machine.

8. The remote operation system according to claim 7, wherein when the switch processing is to be executed by the remote control element, the communication control element ends the communication connected state between the remote operation apparatus and the working machine.

9. The remote operation system according to claim 1, wherein in a case where a predetermined condition including a success in a first time authentication of the operator as one condition is satisfied, the remote control element establishes the communication connected state between the remote operation apparatus and the working machine so as to enable the remote operation of the working machine and executes a second time authentication of the operator before the remote operation is resumed.

10. The remote operation system according to claim 1, wherein the remote input unit is installed in a vicinity of a seat for the operator to sit on.

* * * * *